US007494035B2

(12) United States Patent
Weaver et al.

(10) Patent No.: US 7,494,035 B2
(45) Date of Patent: Feb. 24, 2009

(54) PNEUMATIC COMPRESSOR

(75) Inventors: J. Michael Weaver, Stewartstown, PA (US); Barbara A. Rose, Jackson, TN (US); Mark W. Wood, Jackson, TN (US); Daniel U. Goodwin, Lexington, TN (US); Hung T. Du, Reistertown, MD (US); Alan G. Phillips, Jackson, TN (US); C. Kerwin Braddock, Bel Air, MD (US); James A. Patton, Humboldt, TN (US); Michael A. Lagaly, Jackson, TN (US); Patrick G. Barry, Jackson, TN (US); Julie L. Jones, Jackson, TN (US); Deborah L. Harr, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/415,268

(22) Filed: May 2, 2006
(Under 37 CFR 1.47)

(65) Prior Publication Data

US 2007/0059186 A1 Mar. 15, 2007

Related U.S. Application Data

(63) Continuation-in-part of application No. 10/114,237, filed on Apr. 3, 2002, now Pat. No. 7,225,959.

(60) Provisional application No. 60/676,907, filed on May 2, 2005, provisional application No. 60/356,755, filed on Feb. 15, 2002, provisional application No. 60/286,998, filed on Apr. 30, 2001.

(51) Int. Cl.
*B25C 1/04* (2006.01)

(52) U.S. Cl. ..... 227/2; 227/130; 227/156; 173/217; 417/223; 417/234

(58) Field of Classification Search ..... 227/130, 227/131, 2, 156; 173/20, 217, 216; 417/223, 417/234, 411
See application file for complete search history.

(56) References Cited

U.S. PATENT DOCUMENTS 3,150,488 A 9/1964 Haley (Continued)

FOREIGN PATENT DOCUMENTS

DE 1 963 002 4/1967

(Continued)

OTHER PUBLICATIONS

Palmgren, Palmgren Hipshot Compressor, Palmgren Catalog, 2003, p. 9, (downloaded from http://www.palmgren.com/palmgren/p-wp-compressors-hipshot.html on Sep. 29, 2003).

(Continued)

*Primary Examiner*—Scott A. Smith
(74) *Attorney, Agent, or Firm*—Hunton & Williams

(57) ABSTRACT

A pneumatic compressor capable of supplying compressed gas to a pneumatic tool. The compressor can be powered alternatively by either a battery or an AC power source. The compressor comprises a permanent magnet DC electric motor and circuitry for converting the AC power source to DC power. The compressor includes a receptacle for accommodating one or more of a plurality of batteries and includes circuitry for using batteries having different voltages. The AC power source may also be used to charge a battery connected to the compressor.

20 Claims, 25 Drawing Sheets

U.S. PATENT DOCUMENTS

| | | | | | |
|---|---|---|---|---|---|
| 3,243,100 | A | * | 3/1966 | Adams | 137/565.18 |
| 3,961,868 | A | | 6/1976 | Droege, Sr. et al. | |
| 4,040,164 | A | | 8/1977 | Briles | |
| 4,040,554 | A | | 8/1977 | Haytayan | |
| 4,075,748 | A | | 2/1978 | Buttriss | |
| 4,080,103 | A | * | 3/1978 | Bird | 417/3 |
| 4,215,808 | A | | 8/1980 | Sollberger et al. | |
| 4,331,883 | A | | 5/1982 | Vitaloni | |
| 4,389,166 | A | | 6/1983 | Harvey et al. | |
| 4,614,479 | A | | 9/1986 | Liu | |
| 4,621,984 | A | | 11/1986 | Fussell | |
| 4,656,376 | A | | 4/1987 | Hyldal | |
| 4,656,687 | A | | 4/1987 | Wei | |
| 4,662,551 | A | | 5/1987 | Dudley et al. | |
| 4,700,090 | A | | 10/1987 | Bianchi et al. | |
| 4,759,560 | A | | 7/1988 | Virgulti | |
| 4,789,310 | A | | 12/1988 | Hung | |
| 4,810,915 | A | | 3/1989 | Lissenburg et al. | |
| 4,813,492 | A | | 3/1989 | Biek | |
| 4,830,579 | A | * | 5/1989 | Cheng | 417/234 |
| 4,851,703 | A | | 7/1989 | Means | |
| 5,004,140 | A | | 4/1991 | Fushiya et al. | |
| 5,020,712 | A | | 6/1991 | Monacelli | |
| 5,035,129 | A | | 7/1991 | Denham et al. | |
| 5,052,894 | A | | 10/1991 | Rimington | |
| 5,088,903 | A | | 2/1992 | Tomatsu | |
| 5,102,306 | A | | 4/1992 | Liu | |
| 5,104,295 | A | | 4/1992 | Wong | |
| 5,125,800 | A | | 6/1992 | Wong | |
| 5,127,808 | A | * | 7/1992 | Nichols et al. | 417/411 |
| 5,225,761 | A | * | 7/1993 | Albright | 320/117 |
| 5,378,119 | A | | 1/1995 | Goertzen | |
| 5,399,072 | A | | 3/1995 | Westphal | |
| 5,639,226 | A | | 6/1997 | Boutrup et al. | |
| 5,720,423 | A | | 2/1998 | Kondo et al. | |
| 5,742,147 | A | | 4/1998 | Molina et al. | |
| 5,904,471 | A | | 5/1999 | Woollenweber et al. | |
| 5,931,207 | A | * | 8/1999 | Gianino | 141/382 |
| 6,051,902 | A | | 4/2000 | Ogino et al. | |
| 6,056,519 | A | | 5/2000 | Morita et al. | |
| 6,089,835 | A | | 7/2000 | Suzuura et al. | |
| 6,095,762 | A | | 8/2000 | Wheeler | |
| 6,102,672 | A | | 8/2000 | Woollenweber et al. | |
| 6,145,724 | A | | 11/2000 | Shkolnikov et al. | |
| 6,196,331 | B1 | | 3/2001 | Naito et al. | |
| 6,203,292 | B1 | | 3/2001 | Morita et al. | |
| D440,136 | S | | 4/2001 | Buck | |
| 6,305,048 | B1 | | 10/2001 | Salisian | |
| 6,345,512 | B1 | | 2/2002 | Cosley | |
| 6,376,958 | B1 | | 4/2002 | Koharagi et al. | |
| 6,431,839 | B2 | | 8/2002 | Gruber et al. | |
| 6,468,047 | B1 | | 10/2002 | Huang et al. | |
| 6,530,756 | B2 | | 3/2003 | Morita et al. | |
| 6,551,066 | B2 | | 4/2003 | Saylor et al. | |
| 6,572,000 | B2 | | 6/2003 | Hirai et al. | |
| 6,579,078 | B2 | | 6/2003 | Hill et al. | |
| 6,607,111 | B2 | | 8/2003 | Garvis et al. | |
| 6,632,076 | B2 | | 10/2003 | Morita et al. | |
| 6,746,076 | B2 | | 6/2004 | Kim et al. | |
| 6,755,336 | B2 | | 6/2004 | Harper et al. | |
| 6,766,935 | B2 | | 7/2004 | Pedicini et al. | |
| 6,848,892 | B1 | | 2/2005 | Morita et al. | |
| 6,877,200 | B2 | | 4/2005 | Villarreal | |
| 7,017,342 | B2 | | 3/2006 | Iimura et al. | |
| 2002/0079764 | A1 | | 6/2002 | Cook | |
| 2002/0158102 | A1 | | 10/2002 | Patton | |
| 2004/0173282 | A1 | | 9/2004 | Laetgaard | |
| 2004/0261415 | A1 | | 12/2004 | Negre et al. | |
| 2004/0265134 | A1 | | 12/2004 | Iimura et al. | |

FOREIGN PATENT DOCUMENTS

| | | | |
|---|---|---|---|
| DE | 1 963 002 | | 6/1967 |
| DE | 1 961 238 | | 9/1970 |
| DE | 7 119 407 | | 1/1973 |
| DE | 78 30 718 | | 9/1980 |
| DE | 35 21 300 | A1 | 12/1985 |
| DE | 89 01 883 | | 5/1989 |
| DE | 285 629 | | 12/1990 |
| DE | 90 00 814 | U1 | 7/1991 |
| DE | 92 09 758 | | 11/1992 |
| DE | 42 23 708 | | 1/1994 |
| DE | 295 13 344 | | 1/1996 |
| DE | 295 16 321 | | 1/1996 |
| DE | 296 17 886 | | 8/1997 |
| DE | 297 13 975 | U1 | 11/1997 |
| DE | 298 16 621 | | 2/1999 |
| DE | 200 15 441 | | 1/2001 |
| DE | 201 00 015 | | 8/2001 |
| DE | 202 19 297 | | 4/2003 |
| DE | 102 01 677 | | 6/2003 |
| DE | 203 04 541 | | 7/2003 |
| DE | 103 05 812 | | 9/2004 |
| EP | 0 227 256 | B1 | 5/1991 |
| EP | 0 981 196 | | 2/2000 |
| GB | 2 157 775 | A | 10/1985 |
| GB | 2 215 293 | A | 9/1989 |
| GB | 2 299 380 | A | 10/1996 |
| WO | WO 01/00998 | A1 | 1/2001 |
| WO | WO 01/29421 | | 4/2001 |
| WO | WO 01/92723 | | 12/2001 |
| WO | WO 02/055854 | | 7/2002 |
| WO | WO 02/057630 | A1 | 7/2002 |

OTHER PUBLICATIONS

Campbell-Hausfeld, Cordless Air Compressor with Radio: Replacement Parts List, 2005.

Campbell-Hausfeld, Cordless Air Compressor with Radio: Operating Instructions, 2005, p. 1-7.

Lulu Parts and Electronics, Coleman Powermate Cordless Rechargeable Compressor Model PMC8140, online catalog, (printed from http://store.luluusa.com/colpowcorrec.html on Aug. 17, 2006).

* cited by examiner

PNEUMATIC COMPRESSOR

This application is a continuation-in-part of U.S. patent application Ser. No. 10/114,237, filed Apr. 3, 2002, which application claims priority to U.S. provisional patent application No. 60/286,998, filed Apr. 30, 2001, and to U.S. provisional patent application No. 60/356,755, filed Feb. 15, 2002, each of which is hereby incorporated by reference in its entirety. This application also claims priority to U.S. provisional patent application No. 60/676,907, filed May 2, 2005, which is hereby incorporated by reference in its entirety.

TECHNICAL FIELD

This application relates to pneumatic compressors, including for example pneumatic compressors that are capable of being alternatively powered by a DC battery power source or an AC power source.

BACKGROUND

Portable pneumatic tools such as pneumatic fastening tools, metal piercing tools and crimping tools each require a source of compressed air. Currently, almost all portable pneumatic tools rely upon external air compressors to deliver compressed air via a flexible compressed air hose. External air compressors are typically either shop models or portable models.

Shop air compressors are large, heavy compressors which are often fixed in place and not designed to be frequently moved from one work site to another. An immovable shop air compressor and compressed air hose of finite length limit the ability to take the portable pneumatic tool to where the work is to be performed. The portable pneumatic tool is, in effect, tethered to the fixed shop air compressor and its portability is thereby reduced.

In contrast, portable air compressors do have the ability to be transported from one work site to another. Still, they remain relatively heavy or bulky and awkward to transport—requiring time and manpower to move around the worksite. As with shop models, portable air compressors require a hose to bring the compressed air from the compressor to the tool. Because of the need for a compressed air hose, the portable pneumatic tool remains tethered to the portable air compressor. When the portable air compressor cannot be easily moved around the worksite, the portability of the portable pneumatic tool tethered to the compressor is in turn limited. The lightest and most portable of the portable air compressors are powered by an electric motor. However, these electric powered models then require access to an external electrical power source which is an additional limitation to the portable compressor's portability.

Additionally, portable air compressors having sufficient capacity to power pneumatic tools may use induction motors or series wound AC motors known as universal motors. Induction motors are big, heavy and expensive but can be directly coupled to the compressor or pump. This eliminates the need to couple the motor to the compressor with gears or a belt(s). Series wound AC motors are smaller, lighter and less expensive. However, they are not as efficient as induction motors and in particular, produce low power density at low speeds. They must thus be coupled to the compressor by gears or a belt with a sufficient reduction ratio so that the motor can be run at high speeds to achieve high power densities.

Further, with either class of external air compressor-shop or portable models—the required purchase of the external air compressor to accompany the portable pneumatic tool is an additional expense which can be difficult to bear for some consumers, especially if the external air compressor will serve no other purpose than to power the portable pneumatic tool.

Also, with either class of external air compressor, a hose is required to deliver the compressed air from the external air compressor to the tool. The hose can get in the way of using the tool, can be time consuming to connect and disconnect, adds additional weight that must be carried from one work site to another, and can even be a safety hazard. The hose and required fittings are also an additional expense to the user and will eventually require maintenance or replacement.

Thus, as can be easily seen, the dependence of portable pneumatic tools upon external air compressors limits the portability of these tools, imposes additional costs and reduces their utility.

The utility of a hand-held pneumatic fastening tool, one type of portable pneumatic tool, is particularly affected by its dependence upon an external air compressor. Hand-held pneumatic fastening tools are designed to be quickly carried by hand to where a fastener is to be driven into a workpiece. As explained above, an external air compressor connected to the tool at a minimum complicates moving the hand-held pneumatic fastening tool around the work site. Also, the hose protruding from the tool can get in the way of the work to be done, and can restrict the use of the tool in confined spaces or difficult to reach places. Setup time can also be a problem. Especially when only a few fasteners are to be driven, the time required to setup and connect the external air compressor to the hand-held pneumatic fastening tool is proportionately high to the actual working time of the tool. In some cases, it may take longer to setup the external air compressor than to drive the fastener by hand. In such cases, a user will naturally resort to manually driving the fastener with a hammer.

All of the above-mentioned problems could be overcome if the portable pneumatic tool's dependence upon an external air compressor was eliminated. In the field of hand-held fastening tools, cordless, combustion-based fastening tools have been proposed and produced. One well known type of combustion-based fastening tool uses an internal combustion chamber in lieu of an external air compressor. A combustible gas and air mix in a combustion chamber in these tools. A spark plug ignites this combustible mixture to create pressure that works on a piston to drive the fastener.

While eliminating the dependence upon an external air compressor, these combustion-based fastening tools exhibit other problems. For example, these combustion-based tools require the recurring purchase of proprietary fuel cells available from the tool's manufacturer. One tool's fuel cells typically cannot be used in the tools of another manufacturer. Maintenance can also be a problem. Some of these combustion-based tools require disassembly after every 30,000 or so shots to clean the residue of the combustion. Further, the design and construction of these combustion-based fastening tools differs substantially from other hand-held pneumatic fastening tools resulting in a substantial lack of part interchangeability. Finally, these combustion-based fastening tools cannot be both a cordless fastening tool and a hand-held pneumatic fastening tool relying upon an external air compressor. The ability to be selectively powered by combustion or external compressed air would increase the adaptability of the tool.

U.S. Pat. No. 3,150,488 to Haley, U.S. Pat. No. 4,215,808 to Sollberger et al., and U.S. Pat. No. 5,720,423 to Kondo et al. each propose a hand-held fastening tool which does not rely upon an external air compressor and is not combustion-based.

The Haley patent discloses a fastening tool with a pump. The pump pumps a non-compressible fluid which forces a drive piston rearward in a cylinder. The retraction of the drive piston in turn compresses air in an accumulator. Pulling a trigger switch on the fastening tool activates the pump. At some time after the pump has been running and the air has been compressed in the accumulator, the drive piston reaches the limit of its rearward movement. This causes the separation of the drive piston from an accumulator piston, which in turn allows the compressed air to act on the drive piston. The compressed air drives the drive piston forward to drive the fastener.

The Sollberger et al. and Kondo et al. patents each disclose similar proposed fastening tools. In each of these proposed fastening tools, an electric motor drives a piston rearward in a cylinder through an arrangement of gears and linkages. Pulling the trigger on these tools causes the electric motor to be energized to move the piston rearward in the cylinder. As the piston moves rearward, the air behind the piston which is trapped in the cylinder is compressed. At a certain point, the piston is freed from the driving force of the motor and is rapidly propelled forward in the cylinder by the force of the compressed air trapped behind. As the piston is propelled forward, it strikes and drives the fastener.

In these three patents, each of the proposed designs does eliminate the hand-held fastening tool's dependence upon an external air compressor. However, each of the proposed designs would result in one or more new drawbacks. First, pulling the trigger on each of these fastening tools would not immediately result in the firing of the tool and the driving of the fastener. Rather, pulling the trigger would merely activate the motor or pump which begins the process of compressing the air. Then, after the air has been compressed, a release mechanism would automatically fire the tool and drive the fastener. The lag time between the pulling of the trigger and the firing the tool could be a safety concern. This lag time would also reduce the operating speed of the tool and would make operation of the tool less intuitive for the user.

Second, in these proposed fastening tools the maximum air pressure needed to perform an amount of work on the drive piston sufficient to drive the fastener is much greater than with standard pneumatic fastening tools. The work that the compressed air performs on the drive piston in order to drive the fastener is a result of the compressed air exerting a force on the drive piston as it travels downward in its cylinder. The pressure of the compressed air in a standard pneumatic fastening tool will remain high throughout the drive piston's travel because the compressed air is provided by an external air compressor, which is almost a constant-pressure supply source. In contrast, the pressure of the compressed air in the proposed fastening tools will linearly decrease to zero as the drive piston returns to its start position. Because of the lack of air pressure at the end of the drive piston's travel, there must be a relatively high air pressure at the beginning in order to sufficiently drive the fastener flush with the workpiece.

The necessity for high air pressure in these proposed fastening tools is a disadvantage because compressing the air to such a high pressure is energy inefficient. This can make a difference in the weight of these proposed tools if they are to be powered by batteries. A related effect is that the high pressure could generate a significant amount of heat that must be dissipated. In addition to the reduction in efficiency and increase in heat, holding the high pressure compressed air behind the piston for the relatively long period of time before these proposed fastening tools finally fire will require relatively expensive and possible maintenance-intensive seals around the drive piston.

This need for such high air pressure might be obviated if the air in the cylinder were pre-compressed so that air pressure would be maintained even when the piston is in its start position. While the air in some of the proposed fastening tools in the above patents could be pre-compressed, this would require an additional mechanism onboard the tool to maintain this pressure as the pre-compressed air would inevitably leak out and need recharging.

Third, each of these proposed tools relies upon new and untested mechanisms for compressing the air. These new mechanisms are not present in any present-day hand-held pneumatic fastening tools which rely upon external air compressors. The parts for these new mechanisms, especially initially, will be costly to engineer, design, and produce. Likely, these new mechanisms would not immediately be as reliable as the mature technology embodied in present-day hand-held pneumatic fastening tools.

Thus, while the proposed fastening tools disclosed in the above-described patents would not be reliant upon an external air compressor and would not possess the drawbacks of external air compressors, these proposed tools would suffer other important, and potentially more serious, drawbacks.

SUMMARY

In one embodiment, a portable compressor assembly for providing compressed air to a pneumatic tool comprises a compressor, a port in fluid communication with the compressor, and an electric motor alternatively powered by one of a battery and an AC power supply and operatively connected to and powering the compressor.

In another embodiment, a compressor assembly for providing compressed gas to a pneumatic tool comprises a compressor, a port in fluid communication with the compressor, an electric motor alternatively powered by one of the battery or the AC power supply and operatively connected to and powering the compressor, at least one battery detachably mounted to the compressor assembly, the battery being selectively connectable with the electric motor to provide electric power for driving the electric motor, and an AC power supply for connecting to an AC power source, the AC power supply being mounted to the compressor assembly and selectively connectable with the electric motor to provide electric power for driving the electric motor.

In another embodiment, a high pressure portable air compressor having sufficient capacity to power pneumatic tools has a compressor driven by a permanent magnet DC motor.

In another embodiment, a hand-held fastening tool for driving a fastener into a workpiece comprises a body, a chamber formed in the body, a drive piston received in the chamber for reciprocal movement therein, the drive piston reciprocating in the chamber to drive the fastener into the workpiece, an electrical power source, a compressor and an electric motor each mounted to the body, the electric motor powered by the electrical power source and the compressor powered by the electric motor, a compressed air reservoir in communication with the compressor, the compressed air reservoir storing the compressed air that is compressed in the compressor, and a trigger valve assembly operable to release stored compressed air from the compressed air reservoir into the chamber to drive the drive piston thereby driving the fastener.

In another embodiment, a method of driving a fastener into a workpiece with a hand-held fastening tool comprises the steps of drawing air from the atmosphere and compressing the air in an onboard compressor mounted to the hand-held fastening tool, the compressor powered by an electrical power source, filling a compressed air reservoir with the compressed air compressed in the onboard compressor, and actuating a valve assembly to release compressed air from the compressed air reservoir into a chamber having a drive piston reciprocally movable therein causing the drive piston to move in a chamber formed in the hand-held fastening tool thereby driving a first fastener.

In another embodiment, a method for performing a task with a hand-held pneumatic tool comprises the steps of using an electric motor mounted to the hand-held pneumatic tool to power a compressor mounted to the hand-held pneumatic tool, the compressor having a compressor piston, compressing atmospheric air with the compressor piston, storing the compressed air, actuating a trigger on the hand-held pneumatic tool so that a drive piston positioned in a chamber formed in the hand-held pneumatic tool is driven downward in the chamber by the compressed air, and driving a working mechanism for performing the task with the downward motion of the drive piston.

In another embodiment, a hand-held pneumatic tool comprises a body, a chamber formed in the body, a drive piston received in the chamber for reciprocal movement therein, a working mechanism for performing the work of the hand-held pneumatic tool, the drive piston reciprocating in the chamber to drive the working mechanism, an electrical power source, a compressor and an electric motor each mounted to the body, the electric motor powered by the electrical power source and the compressor powered by the electric motor, a compressed air reservoir in communication with the compressor, the compressed air reservoir storing compressed air that is compressed in the compressor, and a trigger valve assembly operable to release stored compressed air from the compressed air reservoir into the chamber to drive the drive piston thereby driving the working mechanism.

In another embodiment, a portable pneumatic tool system comprises a hand-held pneumatic tool having a body, a chamber formed in the body, a drive piston reciprocating in the chamber under the force of compressed air in the chamber, the reciprocating movement of the drive piston powering a working mechanism for performing a task, and a port in communication with the chamber for bringing compressed air into the chamber. The portable pneumatic tool system also comprises a portable compressor assembly adapted to be borne by a user and having an electric motor operatively connected to and powering a compressor, an electrical power source powering the electric motor, and a port in communication with the compressor for delivering compressed air from the compressor, the portable compressor assembly further having means permitting the portable compressor assembly to be home by a user. The portable pneumatic tool system also comprises a compressed air hose connected at one end thereof to the port of the hand-held pneumatic tool and at a second end thereof to the portable compressor assembly.

In another embodiment, a method of using a portable pneumatic tool system, the system comprises a hand-held pneumatic tool having a drive piston reciprocating in a chamber under the force of compressed air in the chamber, the reciprocating movement of the drive piston powering a working mechanism for performing a task, and a port in communication with the chamber for bringing compressed air into the chamber. The system further comprises a portable compressor assembly adapted to be borne by a user and having an electric motor operatively connected to and powering a compressor, an electrical power source powering the electric motor, and a port in communication with the compressor for delivering compressed air from the compressor. The method of using the system comprises the steps of grasping the hand-held pneumatic tool with the user's hand, attaching the portable compressor assembly to some part of the user's body other than the hand or arm so that the portable compressor assembly is borne by the user, connecting a compressed air hose between the port of the compressor assembly and the port of the hand-held pneumatic tool, compressing atmospheric air in the compressor of the compressor assembly, and introducing the compressed air compressed in the compressor into the chamber of the hand-held pneumatic tool to drive the drive piston thereby driving the working mechanism and performing the task.

In another embodiment, a portable compressor assembly for providing compressed air to a hand-held pneumatic tool comprises a body, a compressor located at least partially inside the body, an electric motor operatively connected to and powering the compressor, at least one battery detachably mounted to the body, the battery providing electrical power to the electric motor, a port in communication with the compressor, the port connectable to a compressed air line for delivering compressed air to the hand-held pneumatic tool, and a control system. The control system comprises pressure sensing means for sensing the pressure of the compressed air available to the port, and control means for controlling the electric motor according to a comparison between the pressure sensed by the pressure sensing means and a predetermined pressure setting, the predetermined pressure setting being selectable by the user during use of the portable compressor unit.

In another embodiment, a portable pneumatic tool system comprises a hand-held pneumatic tool having a body, a chamber formed in the body, a drive piston reciprocating in the chamber under the force of compressed air in the chamber, the reciprocating movement of the drive piston powering a working mechanism for performing a task, and a port in communication with the chamber for bringing compressed air into the chamber. The portable pneumatic tool system also comprises a portable compressor assembly having an electric motor operatively connected to and powering a compressor, a detachably mounted battery powering the electric motor, and a port in communication with the compressor for delivering compressed air from the compressor. The portable pneumatic tool system also comprises a compressed air hose connected at one end thereof to the port of the hand-held pneumatic tool and at a second end thereof to the portable compressor assembly.

In another embodiment, a battery-powered, hand-held pneumatic fastening tool comprises a metal fastening tool body, a plastic cover mounted on the fastening tool body, and a battery detachably mounted on the plastic cover for providing electrical power to the hand-held pneumatic fastening tool.

DETAILED DESCRIPTION OF THE DRAWINGS

An illustrated embodiment is a hand-held, cordless pneumatic brad nailer. It should be understood that while this specification describes the invention through reference to this specific illustrated embodiment, the invention is not limited to a cordless pneumatic brad nailer. Those skilled in the art will comprehend that the invention is equally and in a similar manner applicable to other portable pneumatic tools. Besides brad nailers, the invention is applicable to other hand-held pneumatic fastening tools such as finish nailers, framing nailers, pin nailers, staplers, riveters, etc. Thus, where reference is made to a brad, other fasteners such as nails, pins, staples, rivets, etc. may be substituted. In addition to hand-held pneumatic fastening tools, the invention is also applicable to a wider range of portable pneumatic tools such as metal piercing tools, crimping tools and impact wrenches. In general, the invention is applicable to any portable pneumatic tool requiring relatively infrequent bursts of low volume, high pressure compressed air. The invention is applicable to corded as well as cordless tools. As the energy density of batteries increases with technology advancements in the future, this invention will become more practical to apply to more and more portable pneumatic tools.

While the invention is described through reference to this detailed embodiment, not all of the details described herein are important for practicing the invention. The scope should be ascertained from and shall be measured by reference to the appended claims.

Figure 1:
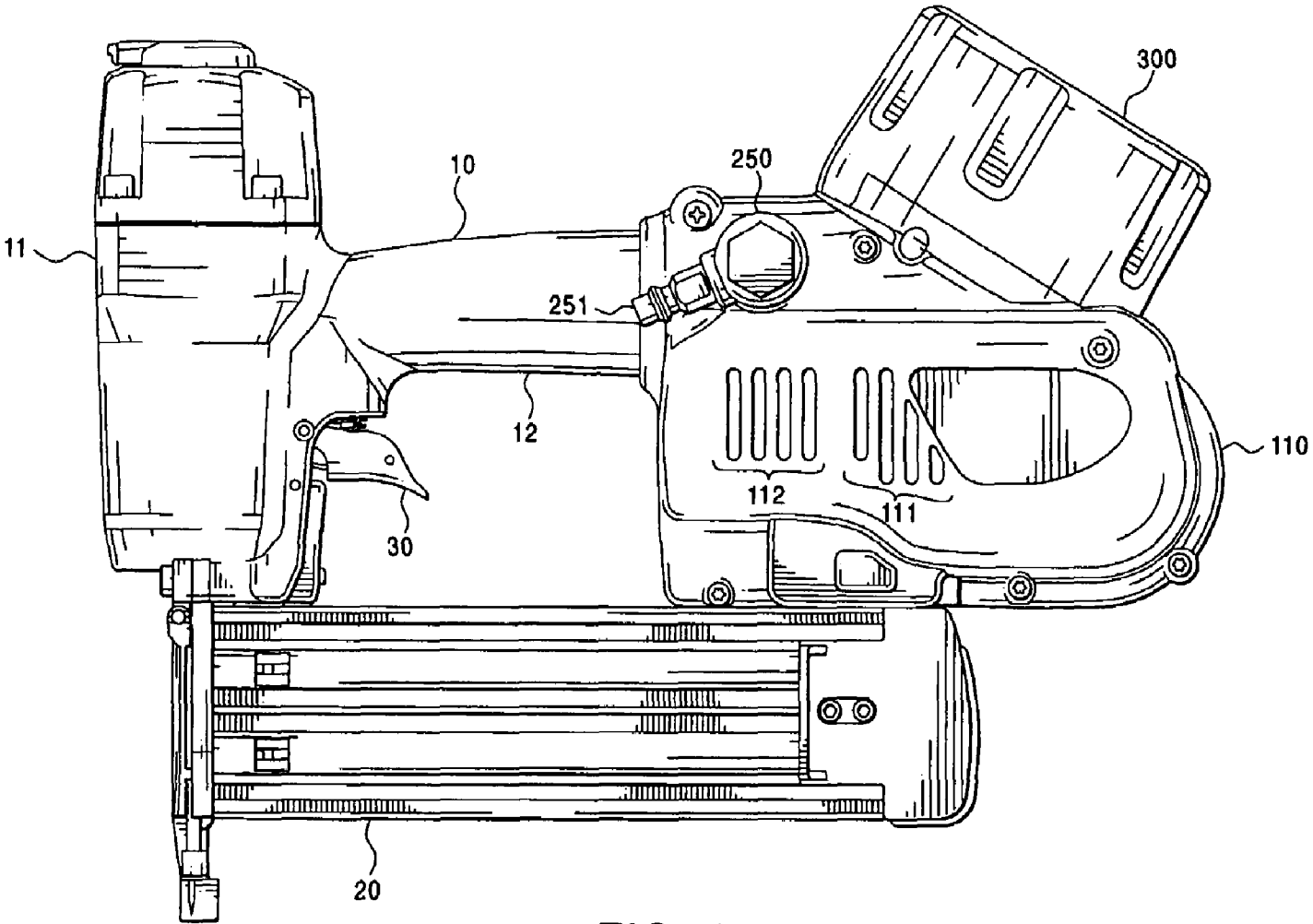
FIG. 1 is a left-side view of a cordless brad nailer according to one embodiment.
Figure 2:
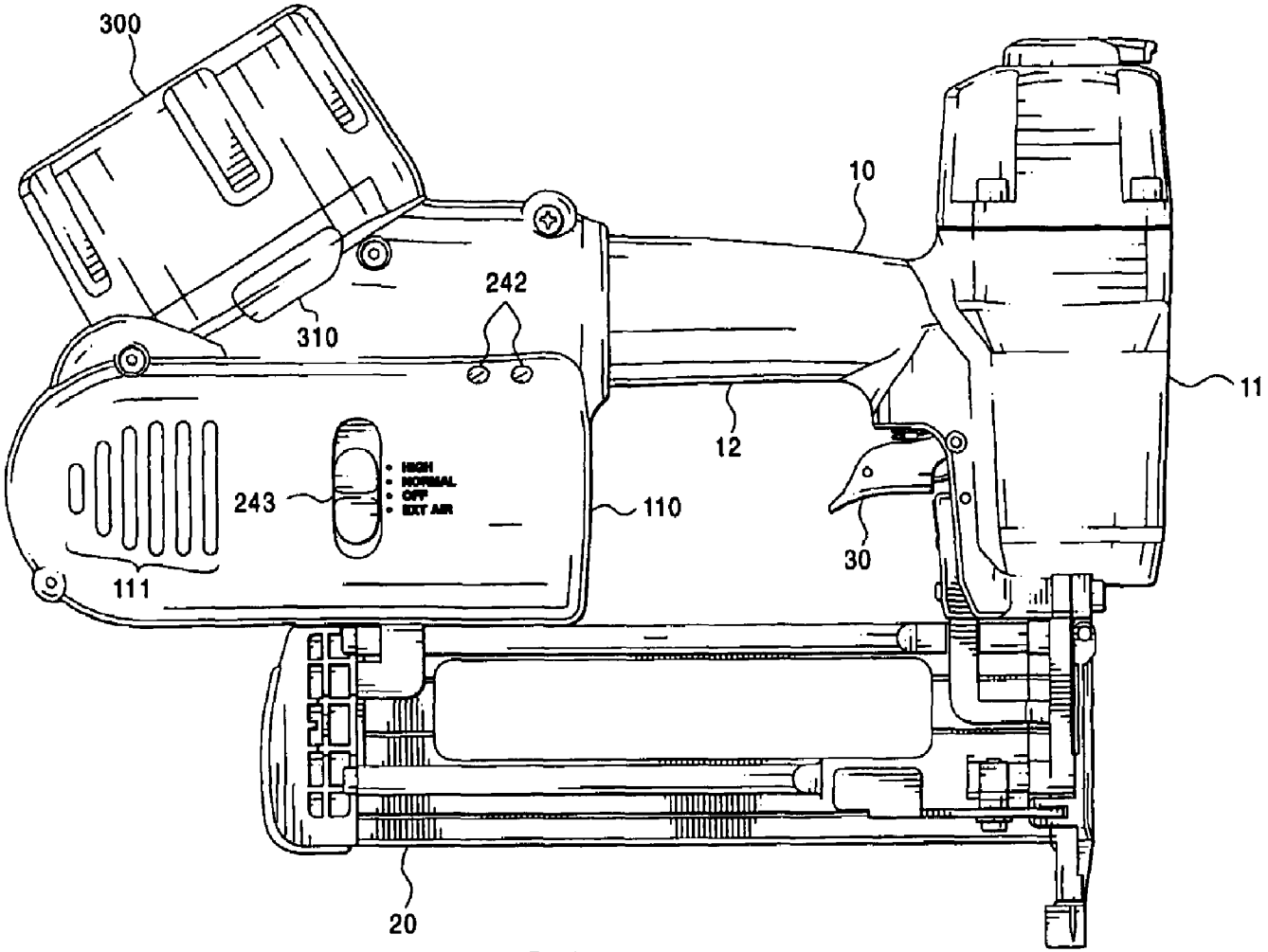
FIG. 2 is a right-side side view of the cordless brad nailer of FIG. 1.

With reference to FIGS. 1 and 2, the brad nailer comprises a body 10 with a head portion 11 and a handle portion 12. The body 10 can be made from aluminum or magnesium alloys, plastic, etc., to minimize the overall weight of the brad nailer, these alloys already being commonly used in this art for this purpose. The body 10 can be a unitary component, or can be constructed from several separate components. A chamber (not shown) is formed within the head portion 11 and holds a drive piston (not shown). The drive piston drives a driver blade (not shown) adapted to strike and drive a brad. The brad is fed to the driver blade by a magazine assembly 20. In its retracted position, the drive piston is located in one end of the hollow chamber in the head portion 11. When compressed air fills the chamber behind the drive piston, the piston rapidly moves forward in the chamber under the force of the compressed air causing the driver blade to strike the brad and drive it into the workpiece. The brad is driven with a single blow from the driver blade, but the brad nailer may also be a multi-blow tool in which the brad is completely driven after multiple blows from the driver blade. A valve system (not shown) controls the introduction of compressed air into the chamber. The valve system includes a trigger 30 which extends from the body 10 and is pulled by a user to actuate the valve system. Many different valve systems for actuating pneumatic tools are known in the art, and any such appropriate valve system may be used.

As already stated, the invention may also be applied to other portable pneumatic tools. In general, portable pneumatic tools have a drive piston which drives a working mechanism adapted to perform a task. Throughout this specification and in the appended claims, reference will be made to a working mechanism to generically refer to any mechanism powered by a drive piston in these tools.

Figure 3:
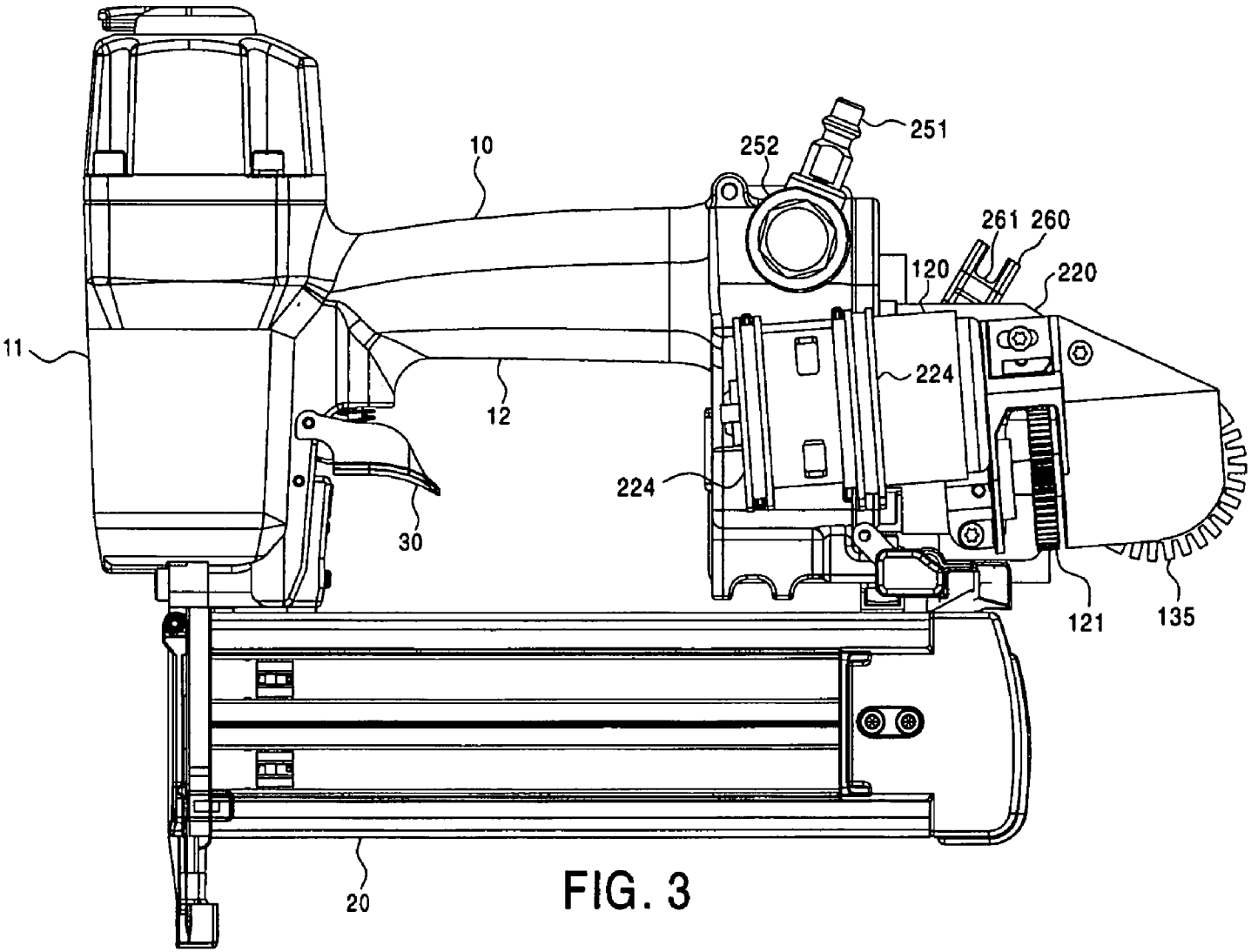
FIG. 3 is a left-side view of the cordless brad nailer of FIG. 1 with the compressor housing removed.
Figure 4:
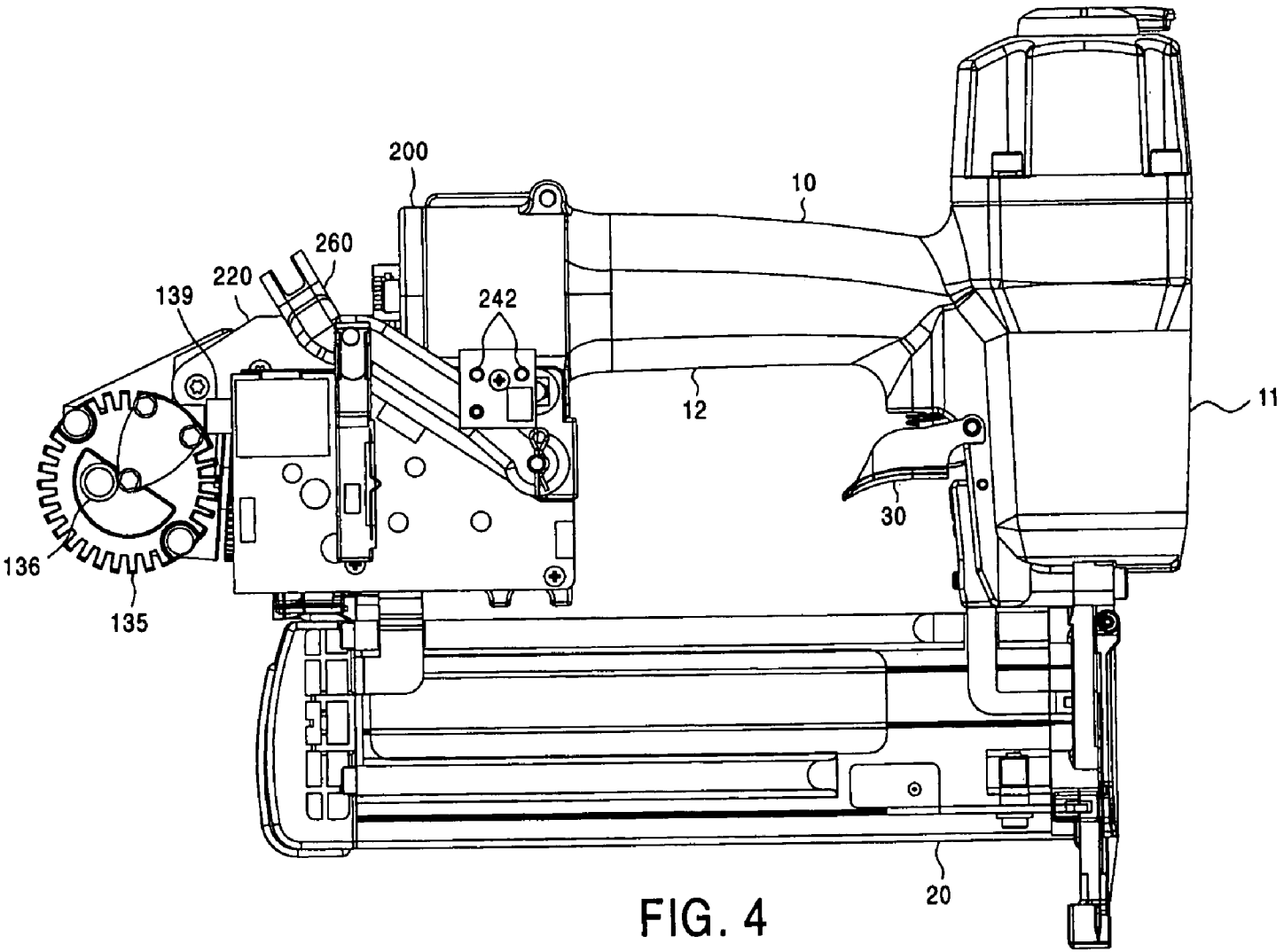
FIG. 4 is a right-side view of the cordless brad nailer of FIG. 1 with the compressor housing removed.
Figure 5D:
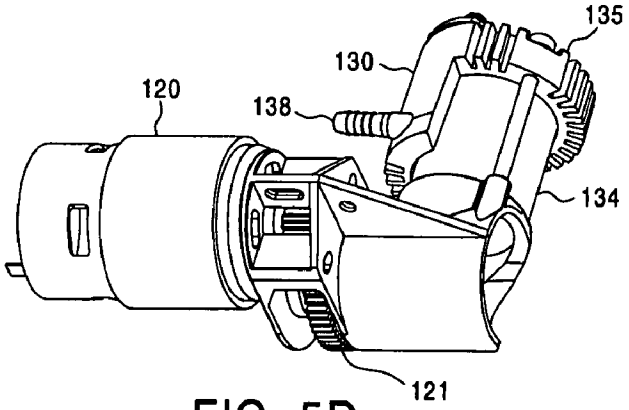
FIGS. 5A-5D are left-side, top, rear and isometric views, respectively, of the compressor assembly of the cordless brad nailer of FIG. 1.
Figure 5C:
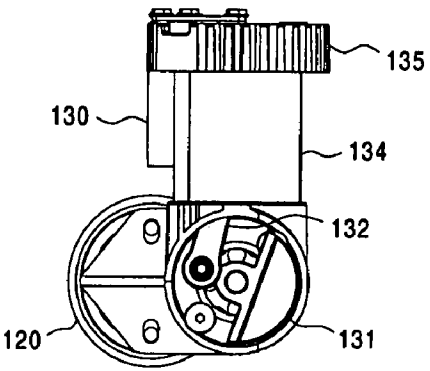
Figure 5A:
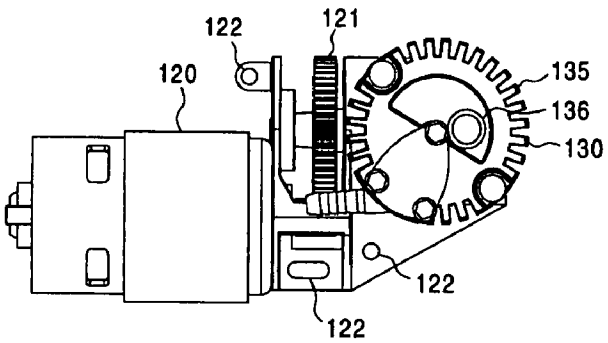
Figure 5B:
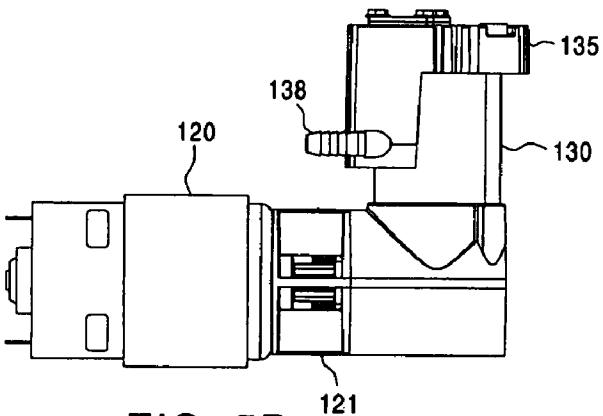
Figure 6:
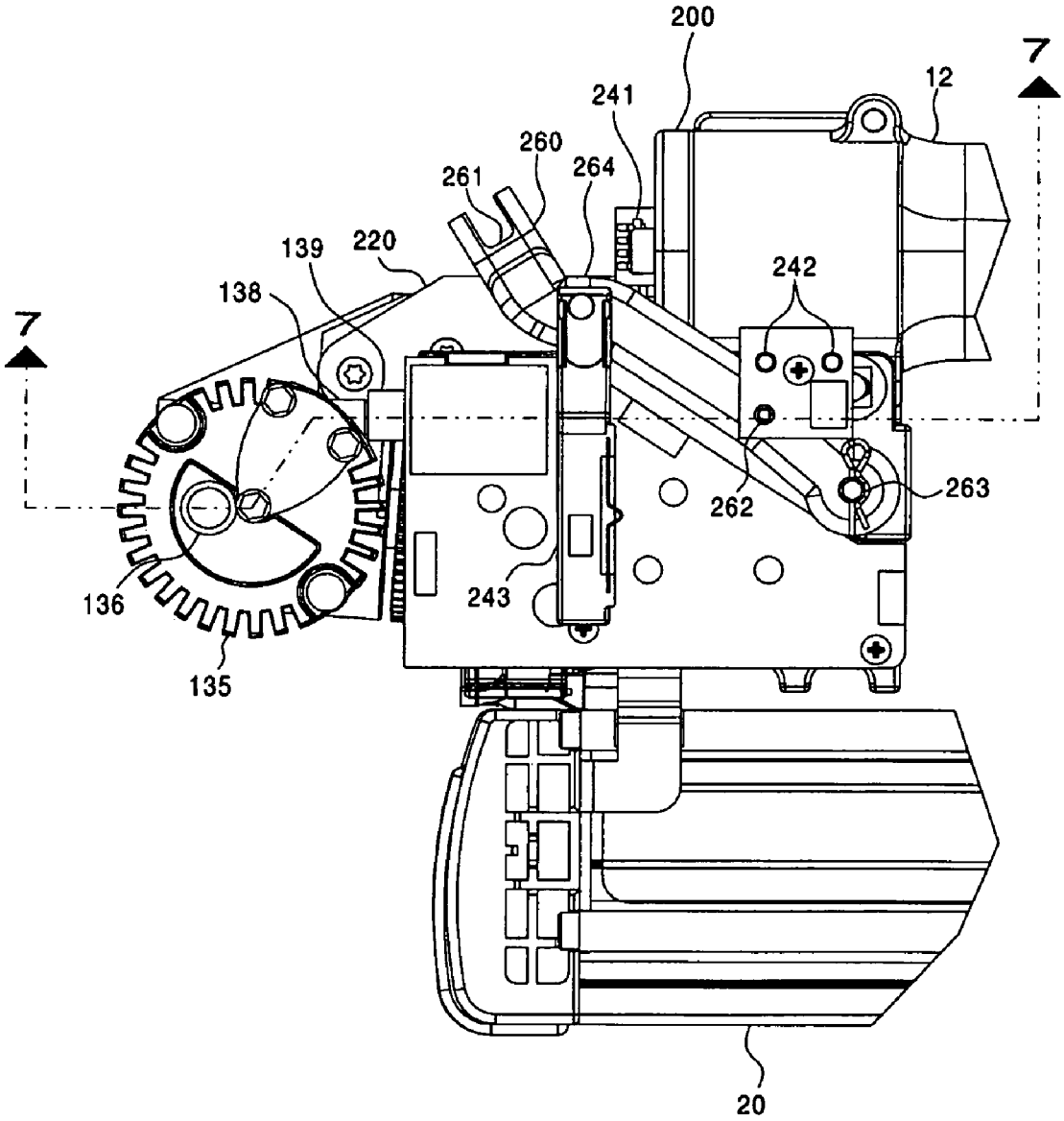
FIG. 6 is a partial right-side view of the cordless brad nailer of FIG. 1.
Figure 7:
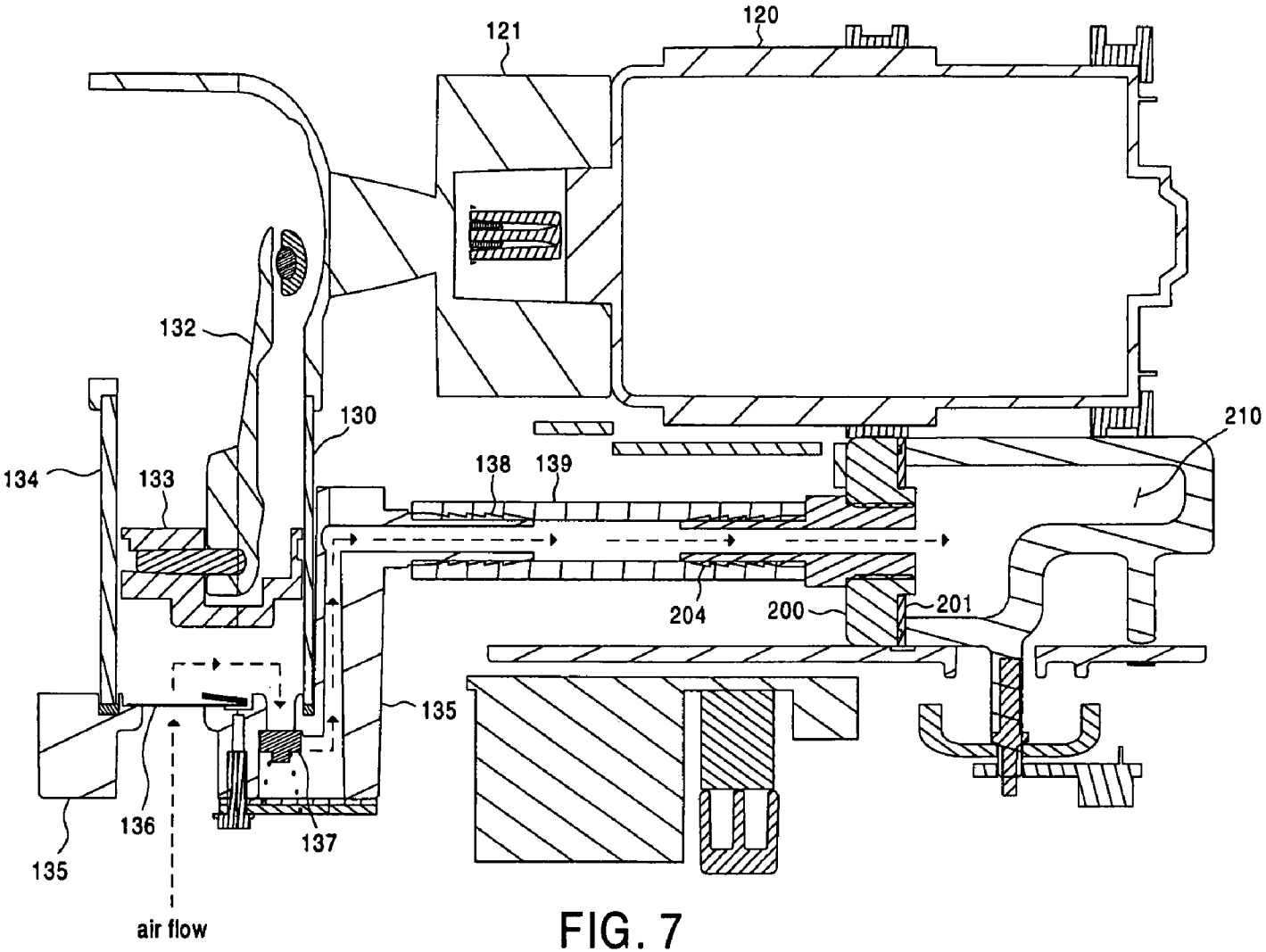
FIG. 7 is a sectional view of the cordless brad nailer taken from cutting plane 7-7 in FIG. 6.
Figure 8:
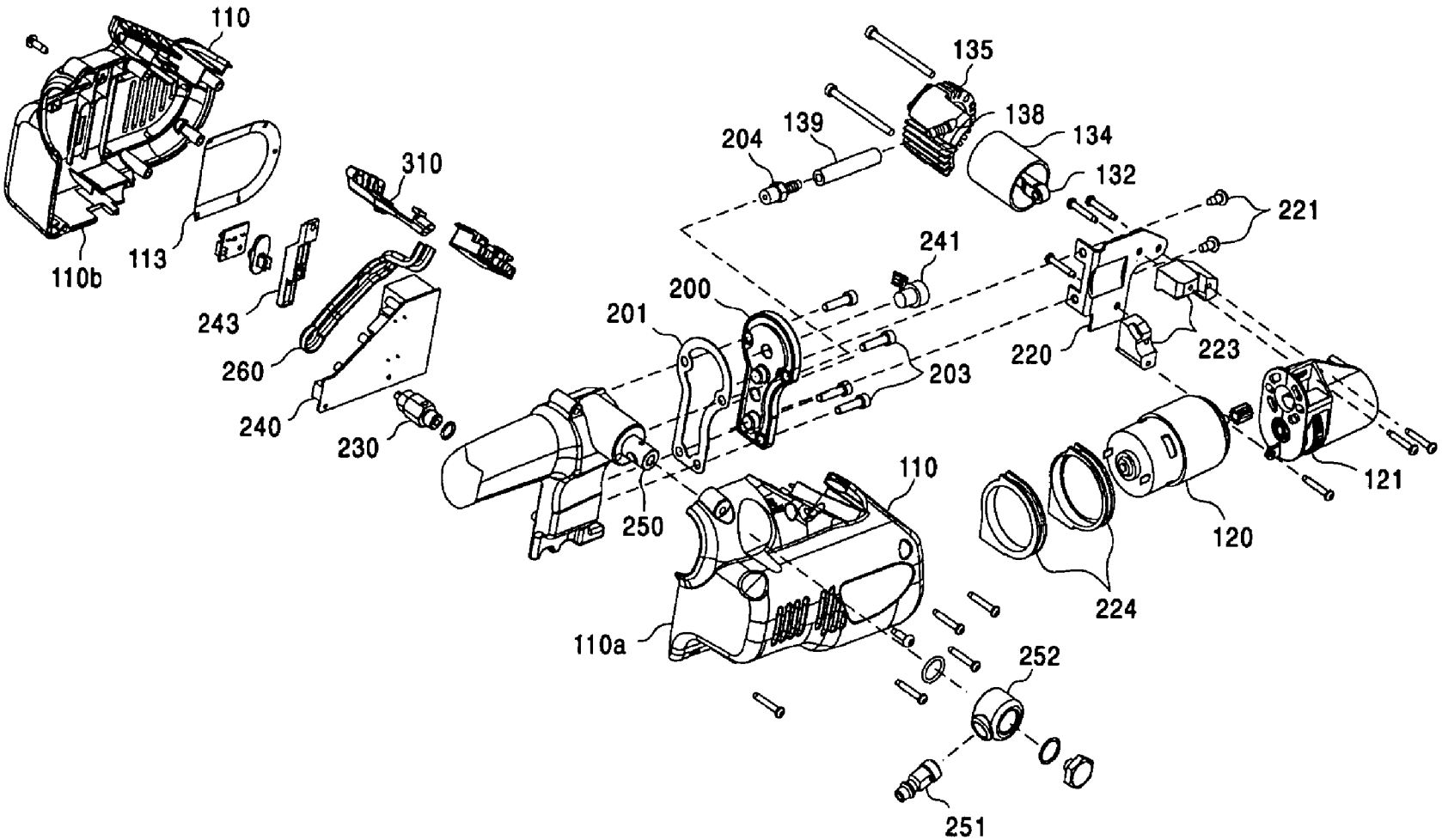
FIG. 8 is a partial exploded assembly view of the cordless brad nailer of FIG. 1.

The compressed air for powering the brad nailer can be provided by an onboard compressor assembly 100. In this embodiment, the compressor assembly 100 is mounted to the body 10 and contained within a compressor cover 110. FIGS. 3 and 4 show the brad nailer with the compressor cover 110 removed to better view the compressor assembly 100. FIGS. 5A-5D are several views of the major components of the compressor assembly 100 removed from the brad nailer. FIG. 7 is a cross-sectional view of the flow path of compressed air in the compressor assembly 100 taken from cutting plane 7-7 shown in FIG. 6.

The scope of this embodiment is not intended to be limited to any particular design for the compressor assembly. Indeed, the compressor assembly can be of any appropriate design capable of being onboard a hand-held pneumatic tool. "Onboard" means that the compressor assembly is mounted on and carried by the tool. In other words, in its ordinary course of use, the tool and its onboard compressor are moved by hand together, as a unit, from one operation to the next. "Mounted" shall be broadly construed to mean both permanent and detachable attachment of one part to another, as well as the attachment of two parts which have been jointly formed as a unitary component. The term mounted shall also include the attachment of one part to another where some degree of relative movement between the two parts is still permitted. The term mounted shall also include both the direct mounting of one part to another, or the indirect mounting of two parts via other parts. By way of example, the onboard compressor can be mounted to a tool by screws, bolts, clamps, latches, hook-and-loop type fasteners, elastic straps, or any other permanent or detachable fastening system.

Referring to FIGS. 5A-5D, compressor assembly 100 comprises two principal components: an electric motor 120, and a compressor 130 which is powered by the electric motor 120. The electric motor 120 can be chosen from any of the many types of electric motors known in the art and suitable for this purpose. In the illustrated embodiment, the electric motor 120 is a DC motor. In particular, the electric motor 120 has a no-load speed of about 14,000 rpm and a stall torque of about 8 in-lbs. Other types of motors may also be used including, for example, a brushless motor.

Figure 21:
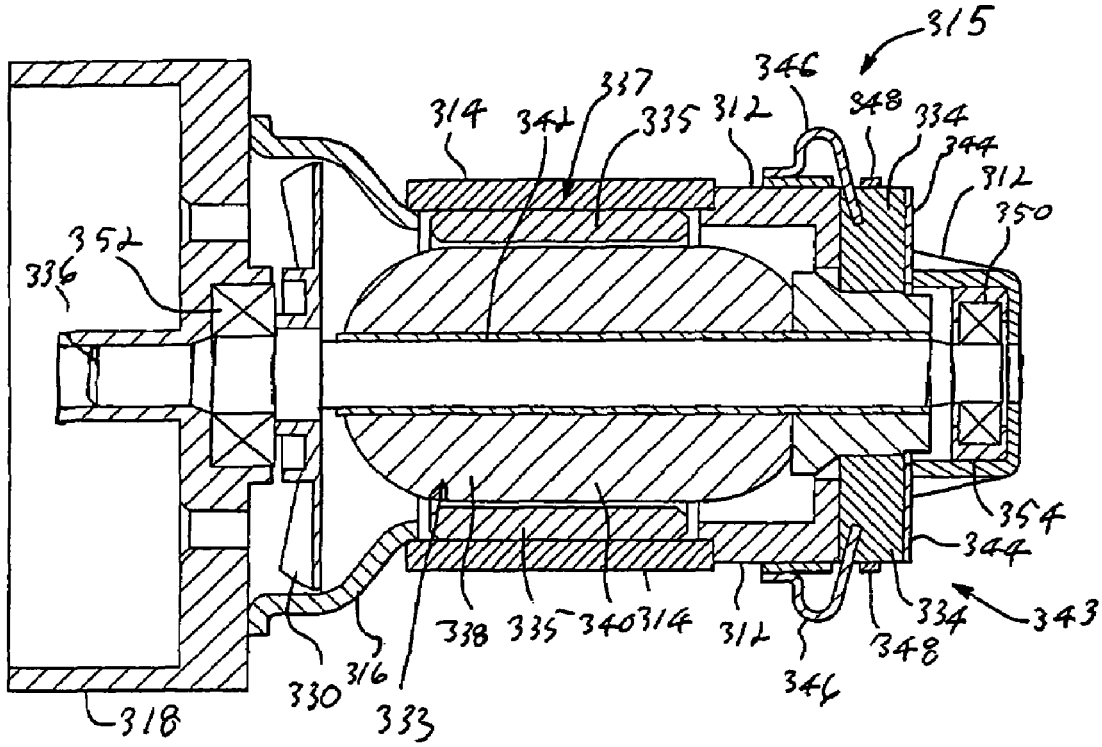
FIG. 21 is a longitudinal cross-sectional view of a permanent magnet DC motor.
Figure 22:
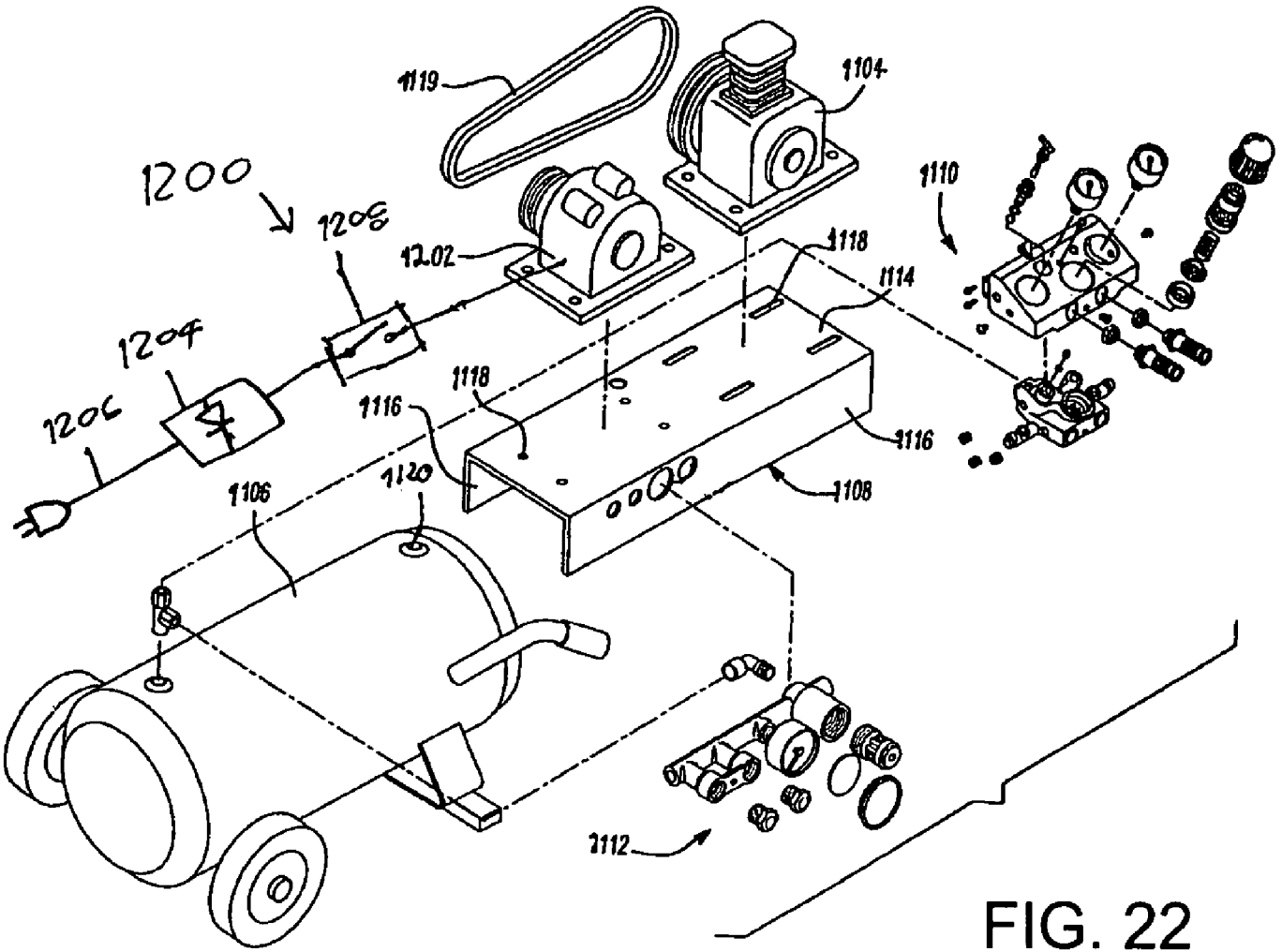
FIG. 22 is an exploded perspective view of an embodiment of a high pressure portable air compressor.

FIG. 21 illustrates an exemplary permanent magnet DC motor for use in a compressor assembly in accordance with embodiments described herein. Permanent magnet DC motor 315 includes an end cap 312, a brush system 343, a wound armature 333, a permanent magnet stator 337 and a motor can 314. The end cap 312 typically provides a rear bearing support such as boot 354. A fan baffle 316 is coupled to motor can 314 and end cap 312. A gear case 318 may illustratively be coupled to fan baffle 316, which also functions as a mounting plate and front bearing support, and couple permanent magnet DC motor 315 to a compressor 1104. (See FIG. 22). Alternatively, permanent magnet DC motor 315 may be coupled to compressor 1104 by belt 119 instead of by gear case 318 or directly to compressor 1104.

Permanent magnet stator 337 includes permanent magnets 335. Permanent magnets 335 may each be a semi-cylindrical magnet member adhered to an inner surface of motor can 314 on opposite sides thereof. It should be understood that permanent magnet stator 337 can include more than two permanent magnets 335, such as four, six, eight, etc.

Armature 333 has an armature shaft 336 around which are positioned laminations 338 in which windings 340 are wound, and a tubular insulative member or sleeve 342 surrounding armature shaft 336. A commutator 332 is affixed on one end of armature shaft 336. Brush system 343 includes brushes 334 at least partially enclosed in brush boxes 344, which are electrically coupled to a power source, such as to an output of rectifier 1204 via power switch 1208. Shunts 346 electrically connect brushes 334 to their respective brush boxes 344. Springs 348 resiliently bias the brushes 334 against the commutator 332.

Opposed ends of armature shaft 336 are received in front and rear bearings 350 and 352. A fan 330 is affixed to one end of armature shaft 336.

Referring again to FIG. 5A-5D, a fan (not shown) is integral with the electric motor 120 for cooling. The electric motor 120 is operatively connected to the compressor 130 via a reduction gear set 121. Reduction gear set 121 reduces the required torque needed to drive the compressor 130 so that the size and weight of electric motor 120 can be minimized. Reduction gear set 121 achieves a reduction of about 4.7. Other arrangements, such as belts and pulleys, could be used. With some arrangements, a flywheel may be necessary to ensure smooth operation. Reduction gear set 121 transfers power from electric motor 120 to the compressor 130 with minimal loss of power and generates little noise and vibration.

The compressor 130 of the illustrated embodiment is a positive displacement, piston type compressor. In particular, the compressor 130 has a bore of about 1.2 inches and a stroke of about 0.8 inches resulting in a displacement of about 0.9 cubic inches. Other types of compressors may also be used, including rotary displacement compressors and gear type compressors, as desired. Additionally, the compressor may be of the permanently lubricated, oil free or oil lubricated type. The compressor 130 comprises an integral crank and counterweight 131, a connecting rod 132 and a compressor piston 133 (FIG. 7) enclosed inside of a compressor cylinder 134. The compressor cylinder is closed by a compressor cylinder head 135.

Compressor 130 operates on a two-stroke cycle. During the intake stroke, suction created by the compressor piston 133 opens a reed-type intake valve 136 (normally biased to its closed position) mounted on the compressor cylinder head 135, permitting air to enter the compressor cylinder 134. During the compression stroke pressure created by the compressor piston 133 opens a spring-biased, check-type exhaust valve 137 (normally biased to its closed position), permitting the compressed air to escape the compressor cylinder 134.

The flow path of the compressed air is shown by the dashed lines and arrows in FIG. 7. After passing through the exhaust valve 137, the compressed air flows through a passage formed in the compressor cylinder head 135 to a nipple 138. From there, the compressed air passes through a flexible tube 139 attached to the nipple 138, and finally through another nipple 204 and into a compressed air reservoir 210.

A compressed air reservoir 210 stores the compressed air from the compressor 130 until it is used to power the drive piston to drive a brad. Many pneumatic fasteners already have a passageway formed in the handle leading from a compressed air hose coupler to the valve assembly, and the compressed air reservoir 210 may be adequately provided by such an existing passageway, or by such an existing passageway in combination with a compressed air hose. Or, the compressed air reservoir 210 may be provided by a small external tank mounted to the body 10. In the illustrated embodiment, the compressed air reservoir 210 is formed in a hollow portion of the handle portion 12, and is completely separate from the compressor 130 and the chamber formed in the head portion 11 of the body 10. A cap 200 is mounted to the handle portion 12 via screws 203 to enclose the compressed air reservoir 210. The cap 200 is sealed to the handle portion 12 by a conventional seal 201.

The onboard compressor assembly 100 is mounted to the body 10 via bracket 220. Bracket 220 is mounted to the cap 200 with screws 221. Mounting points 122 (FIG. 5A) are formed on the compressor assembly 100 to permit screws to attach the compressor assembly to the bracket 220. It may be desirable to isolate vibrations of the working compressor assembly 100 from the body 10. Excessive vibration of the body 10 could make the tool difficult to use, or at least could make holding the handle portion 12 uncomfortable. To isolate vibrations from the compressor assembly 100, the compressor assembly can be mounted using vibration damping means. The vibration damping means can be any material, mechanism or effect which prevents or at least reduces the transfer of at least some vibrations from one body mounted to another. In the illustrated embodiment, the vibration damping means are flexible blocks 223 interposed between the mounting points 122 and the bracket 220. Flexible tube 139 also helps isolate vibrations from the compressor assembly 100. In the illustrated embodiment, the electric motor 120 lies close enough to the body 10 when mounted thereon that excessive vibration could create knocking between the electric motor and the body. To avoid this problem, isolation mounts 224 may be installed around the electric motor 120 and attached to the body 10 to prevent any such contact.

Figure 9:
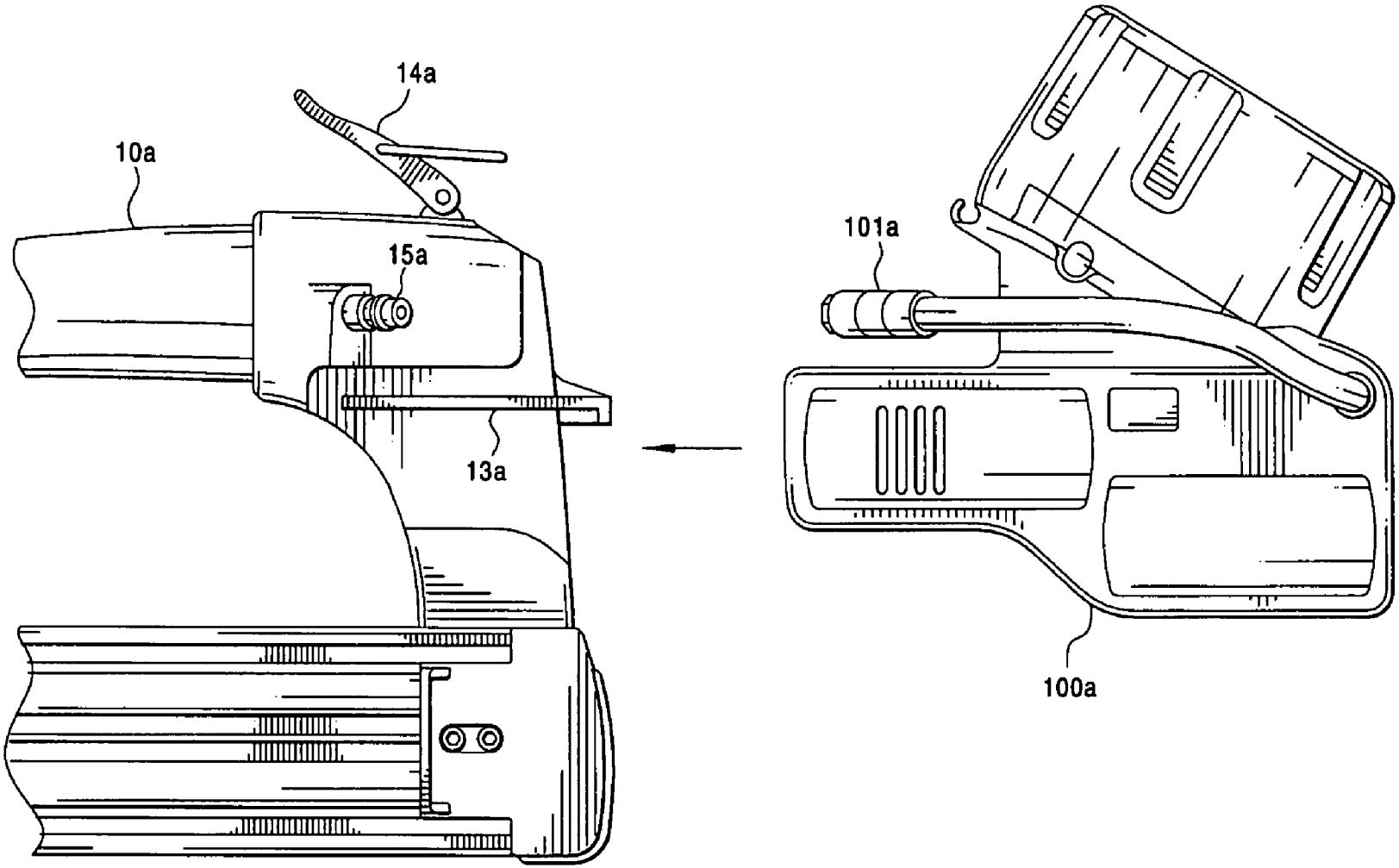
FIGS. 9 and 10 are schematic illustrations of a cordless brad nailer according to another embodiment where the compressor assembly is selectively detachable.
Figure 10:
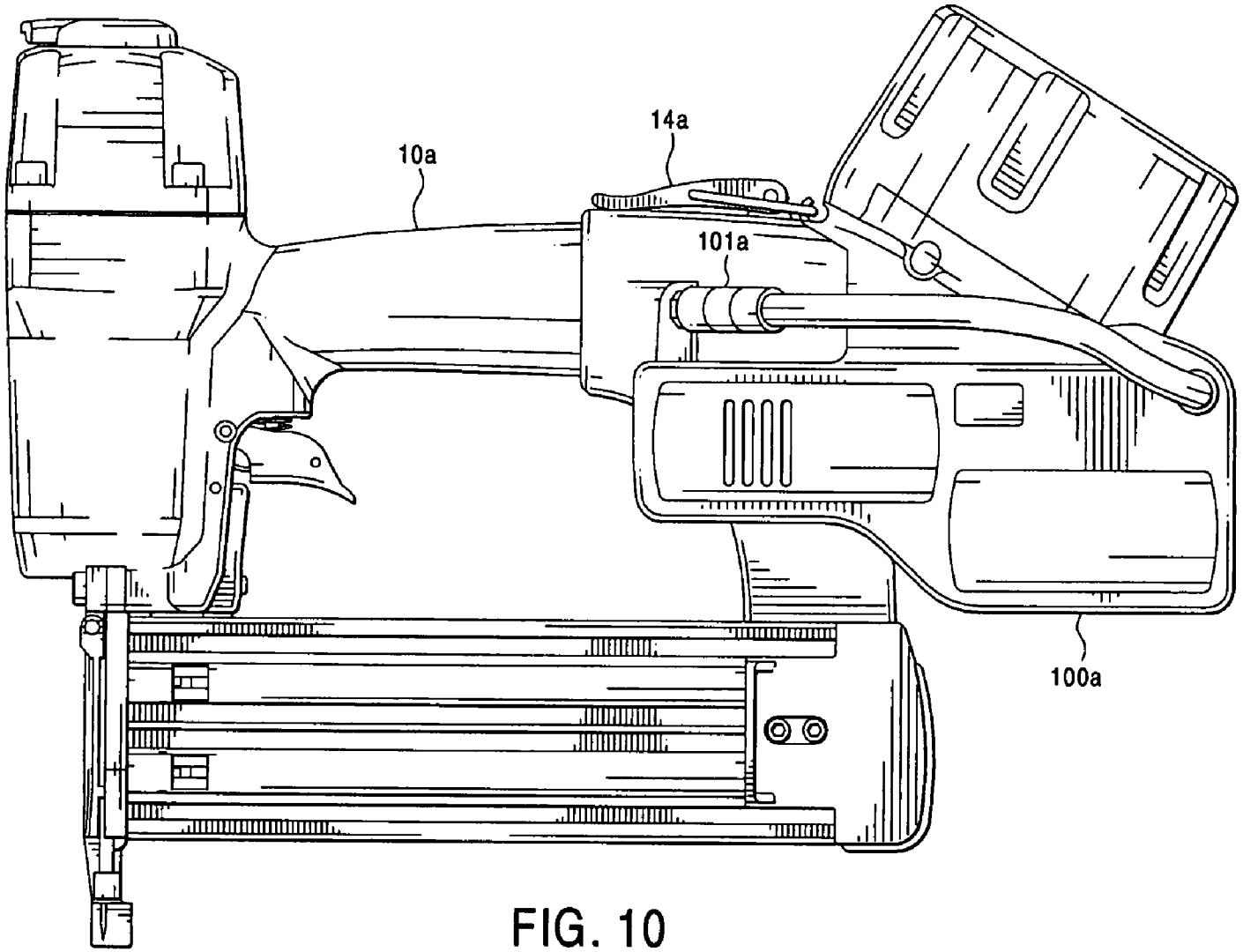

In alternative embodiments, the compressor assembly 100 may be mounted to the body 10 in a detachable fashion. FIGS. 9 and 10 schematically illustrate an alternative embodiment where a compressor assembly 100*a* is completely detachable from a body 10*a* of a brad nailer. The compressor assembly 100*a* could be arranged with grooves which mate with corresponding flanges 13*a* formed on the body 10*a*. Such an arrangement of grooves and flanges would help stabilize the compressor assembly 100*a* on the body 10*a*. A latch 14*a* could be employed to selectively hold the compressor assembly 100*a* on the body 10*a*. A hose 101*a* could extend from the compressor assembly 100*a* and attach to a standard coupler 15*a* on the body 10*a* to bring the compressed air to the brad nailer. The advantage of this alternative embodiment would be the ability to remove the compressor assembly 100*a* and use the brad nailer with an external air compressor attached through an air hose to the coupler 15*a*. Because there may be instances when the user prefers to use an external air compressor, the flexibility of the brad nailer to be powered by an external air compressor or an onboard compressor assembly 110*a* would be appreciated. When the brad nailer is being used with an external air compressor for an extended period of time, the ability to remove the compressor assembly 100*a* from the brad nailer will also be greatly appreciated by some users so that the overall weight of the brad nailer can be minimized.

Figure 11:
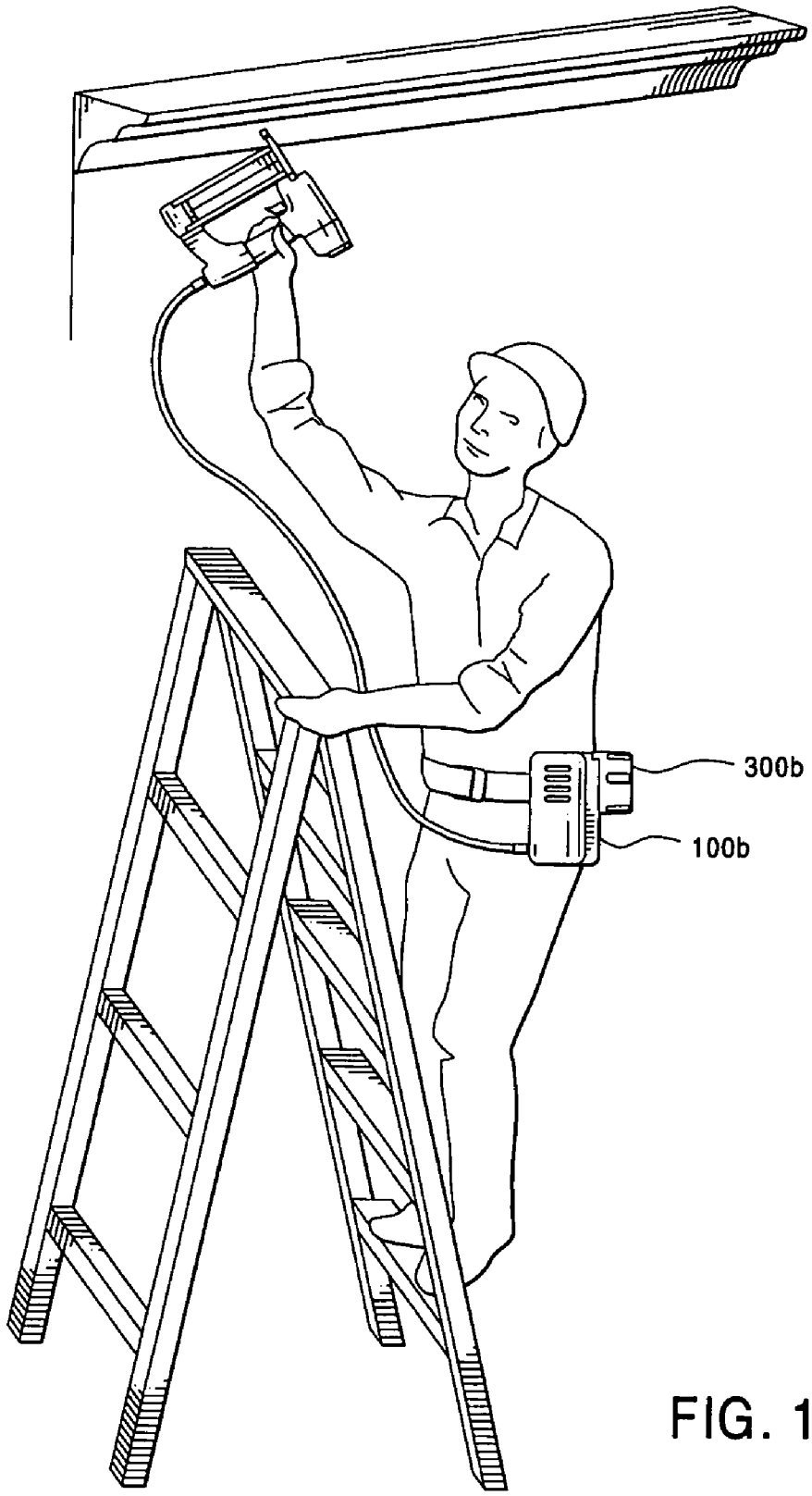
FIG. 11 is a schematic illustration of a cordless brad nailer according to another embodiment where the compressor assembly is borne by the user.

FIG. 11 illustrates another alternative embodiment where a compressor assembly 100*b* would be a separate component from the brad nailer. In this embodiment, instead of being mounted onboard the tool, the compressor assembly 100*b* would be mounted "onboard the user." The compressor assembly 100*b* could include both a compressor and electric motor, as well as a battery 300*b* releasably mounted to the compressor assembly for powering the electric motor. The compressor assembly 100*b* could have more than one battery detachable mounted thereto. Alternatively, the compressor assembly 100*b* could be powered by an electric power cord and an external electrical power source.

The compressor assembly 100*b* could be used with any standard hand-held pneumatic fastening tool or other portable pneumatic tool with a coupler for connecting to a compressed air supply hose. The compressor assembly 100*b* would also include a coupler for attaching a supply hose leading to the pneumatic fastener. A reservoir for storing the compressed air could be provided by the air supply hose or a small external tank.

The compressor assembly 100*b* would be sufficiently small in size and light in weight to be borne by the user such as, for example, on the user's belt. The compressor assembly 100*b* could also be borne by the user in other fashions. What is meant by "borne by the user" is that the compressor assembly 100*b* is releasably attached to the user's body or clothing in some manner so that it can be passively carried around with the user. "Borne by the user" does not include simply carrying the compressor assembly 110*b* by hand. The compressor assembly 100*b* could have means permitting the compressor assembly to be borne by the user which include a belt, belt loop, shoulder straps, hooks, clips, hook-and-loop type fasteners, or any other mechanism for releasably attaching the compressor assembly 100*b* to the user's body or clothing.

The embodiment in FIG. 11 would provide the same portability of the onboard compressor assembly shown in the embodiment of FIGS. 1-8 because no external air compressor is needed. An additional advantage of this embodiment would be that the weight of the compressor assembly 100*b* may be easier to bear around the user's waist, for example, that at the end of the user's arm as is the case with a compressor assembly onboard the tool. In the illustration in FIG. 11, the user is perched on a ladder and lifting the brad nailer high above his body to install crown molding. In such situations a compressor assembly borne around the waist may be preferred to a compressor assembly mounted on the brad nailer itself. Another advantage of this embodiment is that larger or multiple batteries, having a greater capacity for power storage, may be used because the capacity of the body to carry the additional weight may be greater than the capacity of the user's arms to carry the additional weight.

Alternatively, embodiments of the separate compressor component may be placed on the floor or another support surface in the vicinity of the work area rather than being borne by the user. Such embodiments allow the compressor assembly to be larger or shaped in a manner that would be difficult for the user bear continually, and thereby allow the compressor to have a higher capacity. For example, referring to FIG. 22, embodiments of the air compressor 1200 may include a motor 1202, a compressor 1104, a storage tank 1106, a deck 1108, a first panel assembly 1110 and a second panel assembly 1112. Deck 1108 is coupled to storage tank 1106 and includes mounting provisions for motor 1202 and compressor 1104.

Deck 1108 is a generally "U" shaped member having a mounting plate portion 1114 positioned between a pair of downwardly extending side walls 1116. Mounting plate portion 1114 includes a plurality of apertures 1118 for receipt of fasteners (not shown) used to couple motor 1202 and compressor 1104 to deck 1108. Once mounted to deck 1108, motor 1202 is drivingly coupled to compressor 1104 via a belt 1119. During operation, rotation of motor 1202 causes rotation of compressor 1104 thereby initiating a supply of compressed air to an intake port 1120 located on storage tank 1106. While motor 1202 is shown coupled to compressor 1104 via belt 1119, it could also be coupled to compressor 1104 with gears.

An air compressor 1200 in accordance with this embodiment has sufficient capacity to provide compressed air for powering pneumatic tools. For example, storage tank 1106 has a capacity of at least approximately 0.5 L, compressor 1104 has a minimum air flow of approximately 1.0 SCFM at a minimum pressure of approximately 90 PSI, compressor 1104 has a pressure capacity of at least approximately 125 PSI, and/or permanent magnet DC motor 1202 has a minimum running horsepower of approximately 0.5 HP (running horsepower being the horsepower of the motor when it is running at its rated capacity). In an illustrative embodiment, for example, storage tank 1106 has a capacity of approximately 2.5 L, high pressure portable air compressor 1200 has a minimum air flow of 1.0 SCFM at 90 PSI and permanent DC motor 1202 has a no-load speed of 12,000 RPM or less and produces 1.95 HP at 16.5 amps at 10,000 RPM or less.

Returning to the embodiment in FIGS. 1-8 with the compressor assembly 100 mounted onboard the brad nailer, the electric motor 120 may be powered by an onboard battery 300. The battery 300 can be detachably mounted to the compressor cover 110 in any convenient manner. Mounting the battery 300 to the compressor cover 110 also establishes the electrical connection of the battery 300 with the compressor assembly 100. It may also be feasible to mount the battery 300 to some part of the body 10 rather than to the compressor cover 110. For example, battery 300 might be mounted to the top of the head portion 11 of the body 10. Traditionally, pneumatic fastening tools are designed so that the greatest weight of the tool is located in the head portion 11 generally in-line with the force that will be exerted on the fastener. The weight in this location helps prevent movement of the fastening tool when the fastener is struck. Placement of the battery 300 on top of the head portion 11 would advance this objective.

The onboard battery 300 is not the only possible electrical power source for powering the onboard compressor assembly 100, however. In another embodiment, the electrical power source may be an electric power cord which delivers electrical power from an external electrical power source. In yet another embodiment, a battery borne by the user may electrically connect to the brad nailer to power the onboard compressor assembly 100. As can be seen, there are many possible combinations for powering the compressor assemblies shown in FIGS. 1-11 and 22-25.

Figure 20:
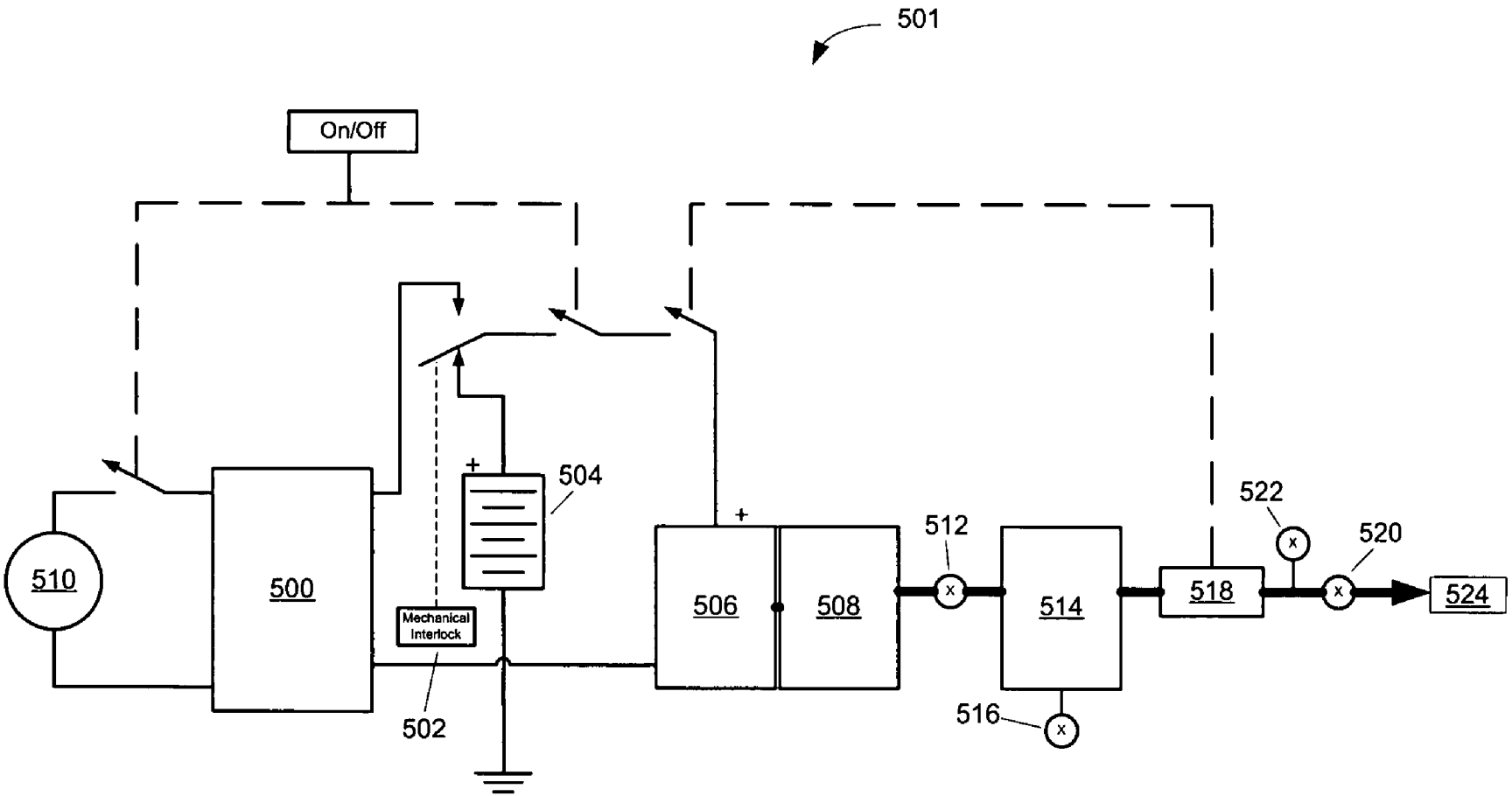
FIG. 20 is a schematic illustration of a compressor according to an embodiment where the compressor is capable of utilizing either AC power or DC power.

For example, referring to FIG. 20, an embodiment comprises a compressor assembly 501 capable of deriving electrical power from either a DC power source, such as a battery, or an external AC power source. Embodiments of the compressor assembly comprise a power conditioning circuit 500, a battery 504, an electric motor 506, and a compressor 508. The operator may selectively choose to use either AC power or DC battery power, or a control system may automatically choose the power source based on factors such as: which power sources are currently connected, the state of charge in the battery, the power demands of the compressor, or other relevant factors. For example, one embodiment accommodates an AC power source of about 90 $V_{AC}$ to about 260 $V_{AC}$ and about 48 Hz to about 63 Hz, or alternatively, a DC battery power source of about 7.0 $V_{DC}$ to about 43 $V_{DC}$.

When the compressor assembly is electrically connected with an AC power source 510, such as a typical wall socket via an electrical cord, an AC voltage feeds into the power conditioning circuit 500. The power conditioning circuit 500 converts the AC power input to a DC voltage output at a level required by the electric motor 506. The power conditioning circuit output is, for example, in the range from about 6.0 $V_{DC}$ to about 43 $V_{DC}$ and may be fixed or adjustable. An embodiment of the power conditioning circuit 500 may comprise, e.g., a regulated switching power supply. Alternatively, any other appropriate power conditioning circuit may be used as would be apparent to one of skill in the art. Embodiments of the compressor assembly may include a mechanical interlock 502 that disconnects the output of the power conditioning circuit when a battery is connected. Further embodiments may comprise a relay to disconnect the battery output when the compressor assembly is connected with an AC power source.

The DC voltage input includes, for example, a single voltage input and may comprise, e.g., a nickel cadmium, lithium ion, nickel metal hydride, or other appropriate battery. Alternatively, the power conditioning circuit 500 may comprise a regulator circuit, implementing a multi-voltage adaptor. The multi-voltage adaptor allows a variety of batteries to power the compressor assembly. Embodiments of the compressor assembly including a multi-voltage adapter may be capable of utilizing a plurality of batteries, either singly or in combination. The batteries may have the same voltage or different voltages. The variation in voltage output may cause the total amount of work power to vary, but would not effect the shot by shot performance of a pneumatic nail gun or other tool connected with the compressor assembly. Further embodiments of the compressor assembly may incorporate a battery charger that would recharge the battery when the unit is connected to AC power.

Referring again to FIG. 20, the electric motor 506 powers the compressor 508. The compressed-air output of the compressor 508 passes through a check valve 512 and into an air reservoir or air tank 514. The air tank 514 has a capacity, e.g., between about 0.5 L and about 60 L, but could be any capacity to fit the application requirements. The tank 514 has an inlet fluidly connected to the check valve 512 and at least one outlet. An over-pressure safety valve 516 is located on a tank output to limit the tank pressure at a safe level. An output of the tank 514 is also fluidly connected to a pressure switch 518. The pressure switch 518 controls the on/off functionality of the electric motor 506 based on the tank pressure. The pressure switch 518 turns the motor 506 on when the tank pressure drops to a certain preset level, and turns the motor 506 off when the tank pressure rises to a certain preset level. The output of the reservoir 514 feeds a regulator valve 520, which controls the air pressure sent to power the pneumatic tool 524. In further embodiments, a first pressure gauge 516 is provided on the tank 514 for monitoring the pneumatic pressure in the tank, and/or a second pressure gauge 522 is provided proximate regulator 520 for monitoring and controlling the output pressure to the tool 524.

Figure 23:
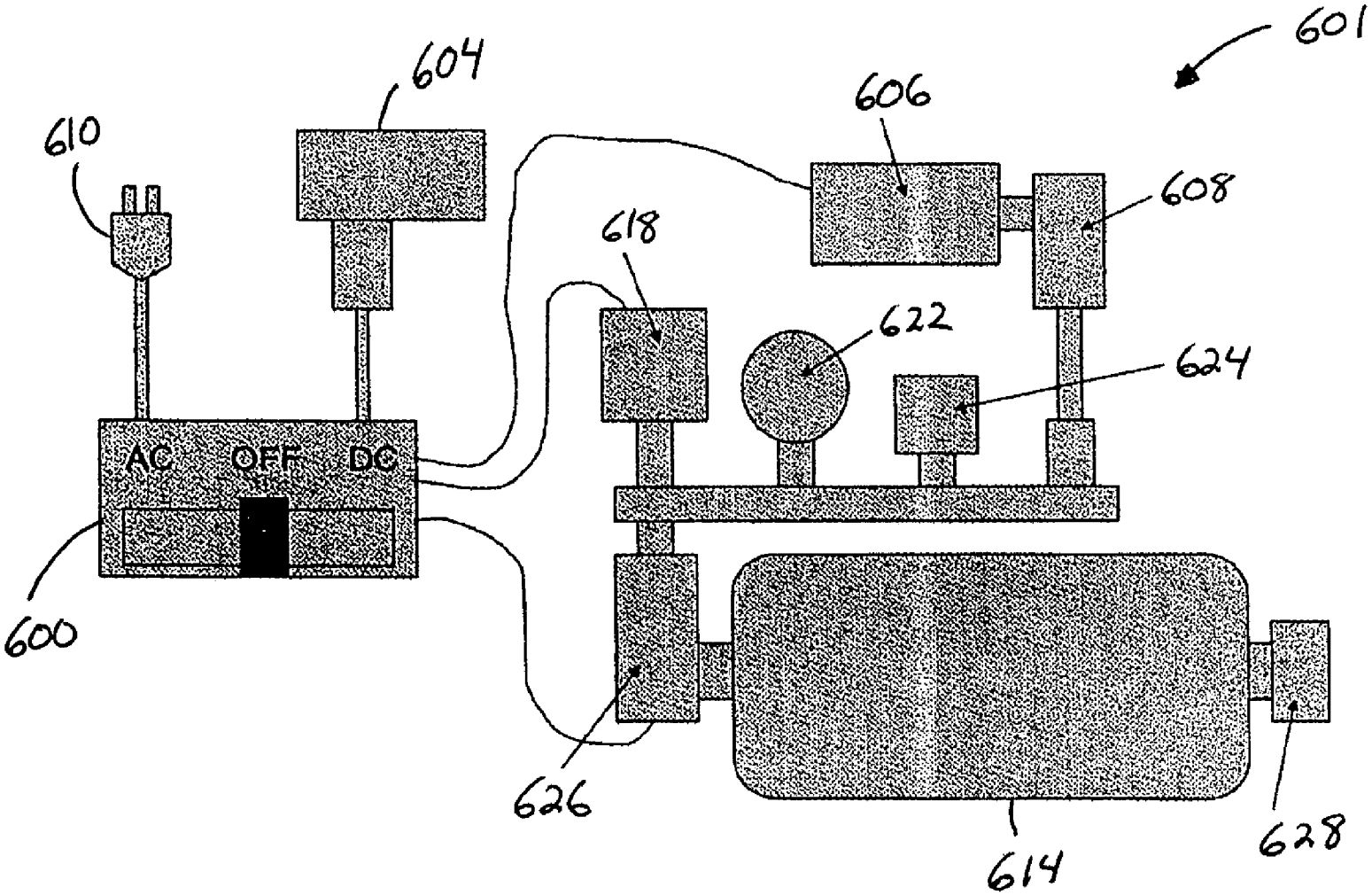
FIG. 23-25 are schematic illustrations of a further embodiment utilizing a solenoid valve to open or close an air reserve tank.
Figure 24:
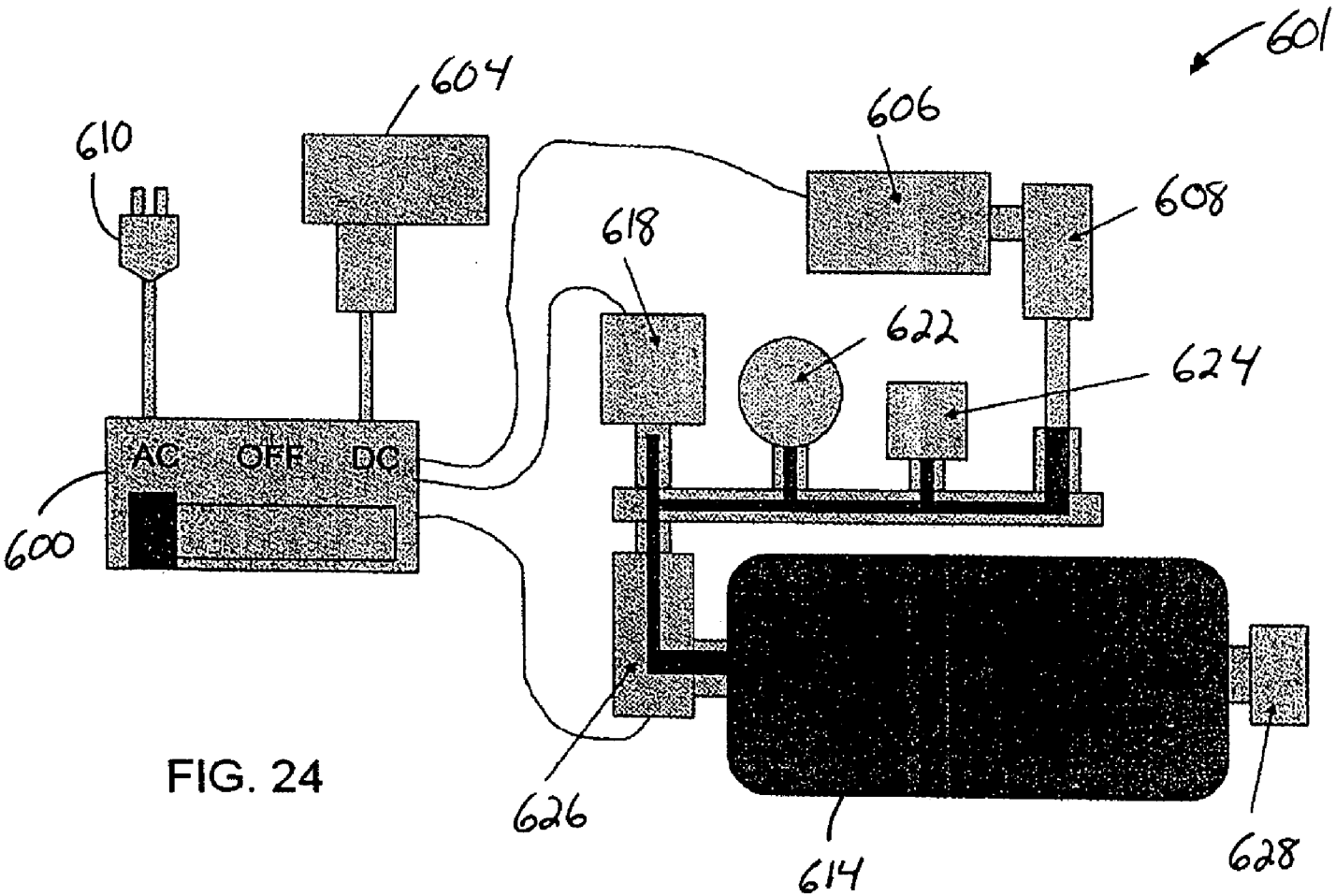
Figure 25:
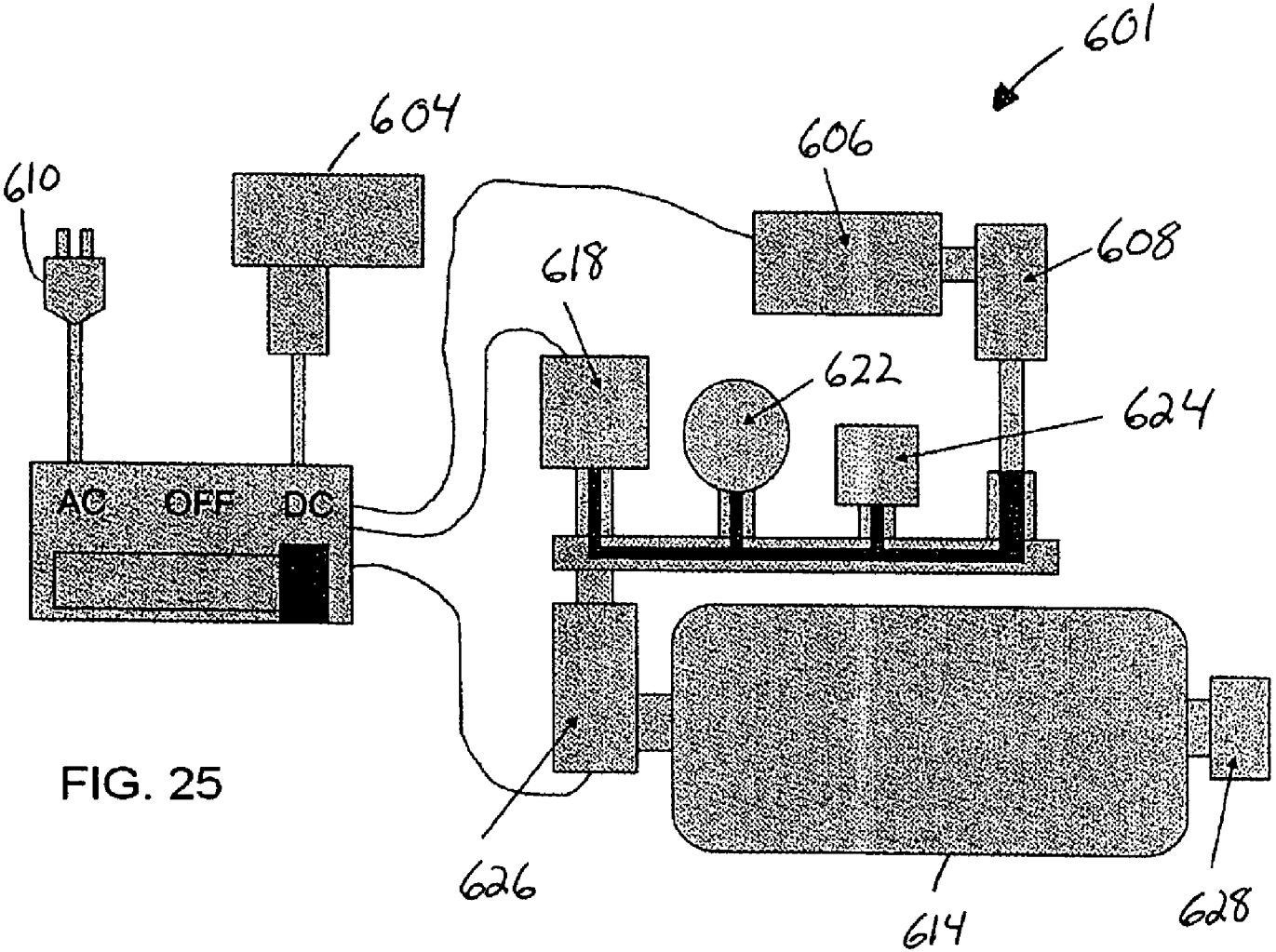

FIGS. 23-25 show a further embodiment of a compressor assembly 601 capable of deriving power from either a DC power source or an external AC power source. Embodiments of the compressor assembly 601 comprise a switch assembly 600, a battery 604, an AC power input 610, an electric motor 606, and a compressor 608. The switch assembly 600 comprises means to selectively choose either AC power 610 or DC battery power 604. Alternatively, a control system may automatically choose the power source. The switch assembly 600 comprises a power conditioning circuit that converts the AC power input 610 to a DC voltage output at a level required by the electric motor 606. The compressor assembly 601 further comprises an air reserve or storage tank 614 and a solenoid valve 626 fluidly connected with a tank inlet between the compressor 608 and the tank 614. Embodiments of the compressor assembly also comprise a tool connection port 624, a pressure gauge 622, and a pressure switch 618 fluidly connected with compressor 608 between the compressor and solenoid valve 626.

As illustrated in FIG. 24, when the compressor assembly 601 operates in an AC mode, electric motor 606 draws power from the AC power source 610 and solenoid 626 is open allowing compressor 608 to fluidly connect with tank 614. Compressor 608 can pressurize tank 614 and provide a reserve of compressed air for use with a pneumatic tool. Alternatively, as illustrated in FIG. 25, when the compressor assembly 601 operates in a DC mode, electric motor 606 draws power from battery 604, solenoid 626 is closed, and compressor 608 provides compressed air directly to tool port 624 without use of tank 614. Pressure switch 618 may control the on/off functionality of the electric motor 606 based on the pressure available at tool port 624. The pressure switch 618 turns the motor 606 on when the pressure drops to a certain preset level, and turns motor 606 off when the pressure rises to a certain preset level. Pressure gauge 622 shows the pressure available at tool port 624. Additionally, tank 614 may comprise an additional pressure switch (not shown) for controlling motor 606 in response to tank 614 pressure when in AC Mode. Tank 614 may also include a relief valve 628 and a further pressure gage (not shown) showing tank pressure.

In the manner described, embodiments of the compressor assembly may provide advantages of both a DC battery powered compressor and an AC powered compressor. The DC mode illustrated in FIG. 25 provides a compressor assembly that is portable and convenient. Because solenoid 626 is closed in the DC mode, the compressor assembly can be used without requiring the extra time or depletion of the battery charge that would be required to fill the tank. However, when the compressor is attached to an AC power source, power consumption is not a significant concern. As shown in FIG. 24, solenoid 626 is open, and the compressor maintains the advantages of an air reserve tank for use in longer or more intensive jobs.

Referring to FIGS. 1-1, the compressor cover 110 can be a unitary or multipart, plastic or metal component which is shaped to fit around the compressor assembly 100 and is attached to the compressor assembly 100 or the body 10, or both. The compressor cover 110 is attached only to the body 10 so that the compressor assembly 100 will be free to vibrate somewhat underneath the compressor cover 110. In the illustrated embodiment, the compressor cover 110 comprises two clam shell halves 110*a*, 110*b* each made from injection molded plastic. Plastic helps minimize the weight of the cordless brad nailer as well as insulate the heat of the compressor assembly 100 from the user's hands.

The compressor cover 110 protects the user from any exposed moving parts of the compressor assembly 100 and from any parts of the compressor assembly 100 which may become very hot during use such as the compressor cylinder head 135. The compressor cover 110 can also enhance the clean aesthetic appearance of the brad nailer. Air vents 111, 112 (FIGS. 1 and 2) may be formed in the compressor cover 110 to allow cooling air to enter therein and cool the compressor assembly 100 and to allow intake air to reach intake valve 136. An air gap is left between the interior of the compressor cover 110 and the compressor assembly 100 to allow cooling air to flow between them. Additionally, ribs formed on the interior of the compressor cover 110 may be provided to create a shroud around the fan (not shown) of the electric motor 120. The shroud will prevent air from circulating inside of the compressor cover 110 through the fan, thus creating a flow of cooling air which enters the compressor cover 110 through one set of air vents 111, passes through the fan, and exits the compressor cover 110 through a second set of air vents 112. Because some of the air intake through the air vents 111 will enter the compressor 130, a screen 113 may be placed over the air vents 111 to help prevent debris from entering the compressor 130 or clogging the intake valve 136. Additionally, it may be desirable to include a foam filter between the screen 113 and the intake valve 136 to further help prevent a build-up of sawdust or other material from clogging the intake valve.

One feature of this invention is that many of the components of the cordless brad nailer are the same as traditional components for a pneumatic fastening tool. For example, the drive piston and valve system of the cordless brad nailer may be the same as those used in a standard pneumatic brad nailer. Using these standard parts is advantageous because these parts have already been field-tested and proven, ensuring their reliability. Also, a ready supply of spare parts is available to consumers should they break because these parts are already in wide spread commercial use. The cost of the cordless brad nailer is also minimized because tooling for making these parts already exists. The same ability to use standard pneumatic tool parts will apply equally when the invention is applied to other hand-held pneumatic fastening tools, or other portable pneumatic tools, because the fundamental process in these tools for using the energy of compressed air to perform the work will remain unchanged by the addition of an onboard compressor assembly.

While the purpose of this invention is to overcome a hand-held pneumatic tool's dependence upon an external air compressor, external air compressors remain advantageous in many situations. Therefore, another feature is the ability to be selectively powered by either an onboard compressor assembly or an external air compressor. In order to accommodate an external air compressor, a port 250 (FIG. 8) can be included to allow a compressed air hose to connect to the compressed air reservoir 210 and deliver compressed air from an external air compressor. The port 250 includes a coupler 251 of a standard design for quickly connecting and disconnecting to a compressed air hose. In order to prevent the compressed air from escaping from the compressed air reservoir 210 when a compressed air hose is not connected to the coupler 251, a valve 252 is incorporated into the port 250. When the valve 252 is open, the coupler 251 communicates with the compressed air reservoir 210. When the valve 252 is closed, no compressed air can pass from the compressed air reservoir 210 through the coupler 251. The valve 252 in the illustrated embodiment is manually actuated by turning the coupler 251 by hand from the closed position shown in FIG. 1 to the open position shown in FIG. 3.

A pressure relief valve 230 (FIG. 8) may be connected to the compressed air reservoir 210 to relieve any excess pressure of the compressed air. In addition to being automatically actuated when the pressure of the compressed air exceeds a certain pressure, the pressure relief valve 230 may be arranged so that it is manually actuated when the battery 300 is detached from the compressor cover 110. A battery release button 310 (FIGS. 2 and 8) is depressed to detach the battery 300 from the compressor cover 110 in a known manner. When the battery release button 310 is depressed, it pushes against a first end 261 of a lever 260 (FIG. 6). Lever 260 pivots about a point 262. When the lever 260 pivots upon activation of the battery release button 310, it pulls on the pressure relief valve 230, to which it is connected at a second end 263, causing the compressed air in the compressed air reservoir 210 to be released. It is thought that release of the compressed air when the battery 300 is removed may be desirable because users may mistakenly believe that the brad nailer cannot be fired after the battery 300 has been removed. For similar reasons, a switch 243 (FIG. 2) for turning the nailer on and off can be arranged so that when the switch 243 is moved to the off position, it pushes against the lever 260 near an interface 264 (FIG. 6), pivoting the lever 260 about point 262 and actuating the pressure relief valve 230 to release the compressed air when the nailer has been turned off.

In each of the embodiments described above, the compressor assembly may include a control system which turns the electric motor on and off according to the demand for compressed air. Of course, such a control system is not absolutely necessary because the compressor could be set to run continuously when the tool is in use while the pressure relief valve 230 relieves excessive compressed air if the supply does not match the demand. A control system may provide advantages over this simple set-up, e.g., for several reasons set forth below in the description of possible control systems. In the description of each of the possible control systems, reference will be made to the illustrated embodiment—a cordless brad nailer. It should be understood that the described control systems may also be applied to any of the embodiments, as desirable, in a similar manner.

In one possible simple form, the control system will turn the electric motor 120 on when the pressure in the compressed air reservoir 210 is less then a first predetermined pressure and will turn the electric motor 120 off when the pressure is greater than a second predetermined pressure. The first and second predetermined pressures could be the same, if desired. The first and second predetermined pressures could be selectable by the user during use of the brad nailer, or they could be set at the factory when the brad nailer is built. In any of these possible combinations of features, the control system could simply comprise a pressure sensitive switch, or switches, which sense the pressure of compressed air in the compressed air reservoir 210 and which control the flow of electric energy to the electric motor 120. This control system will help conserve electrical power by not requiring that the compressor run continuously when the tool is in use. Conservation of electrical power is especially vital when the brad nailer is powered by an onboard battery.

This control system also makes using the tool more comfortable. The compressor assembly 100 will create noise and vibration when in use that may bother the user if the noise and vibration are continuous.

In another form illustrated in the accompanying drawings, the control system could comprise a pressure transducer 241 (FIG. 8) which monitors the pressure in the compressed air reservoir 210. The pressure transducer 241 is mounted to the cap 200 and returns an electronic signal indicative of the pressure. The electronic signal from the pressure transducer 241 is received by control circuitry 240. Control circuitry 240 (shown diagramatically in FIG. 8) comprises so-called one-time programmable microchips and other known components. Control circuitry 240 receives and processes the electronic signal from the pressure transducer 241. Control circuitry 240 uses the electronic signal to control the flow of electrical power to the electric motor 120. In addition, control circuitry 240 may also include sensors and components for sensing certain parameters relating to the state of the battery 300 or for sensing other inputs, as desired. Control circuitry 240 can be turned on and off through a switch 243 (FIG. 2) mounted to the compressor cover 110. Control circuitry 240 may also have the ability to control output devices such as LEDs or audible buzzers. For example, a set of LEDs 242 (FIG. 2) may be mounted on the exterior of compressor cover 110 to indicate various operating states or faults of the brad nailer. The control circuitry 240 receives this input or these inputs and controls the electric motor 120 and other output devices according to a programmed logic.

Figure 12:
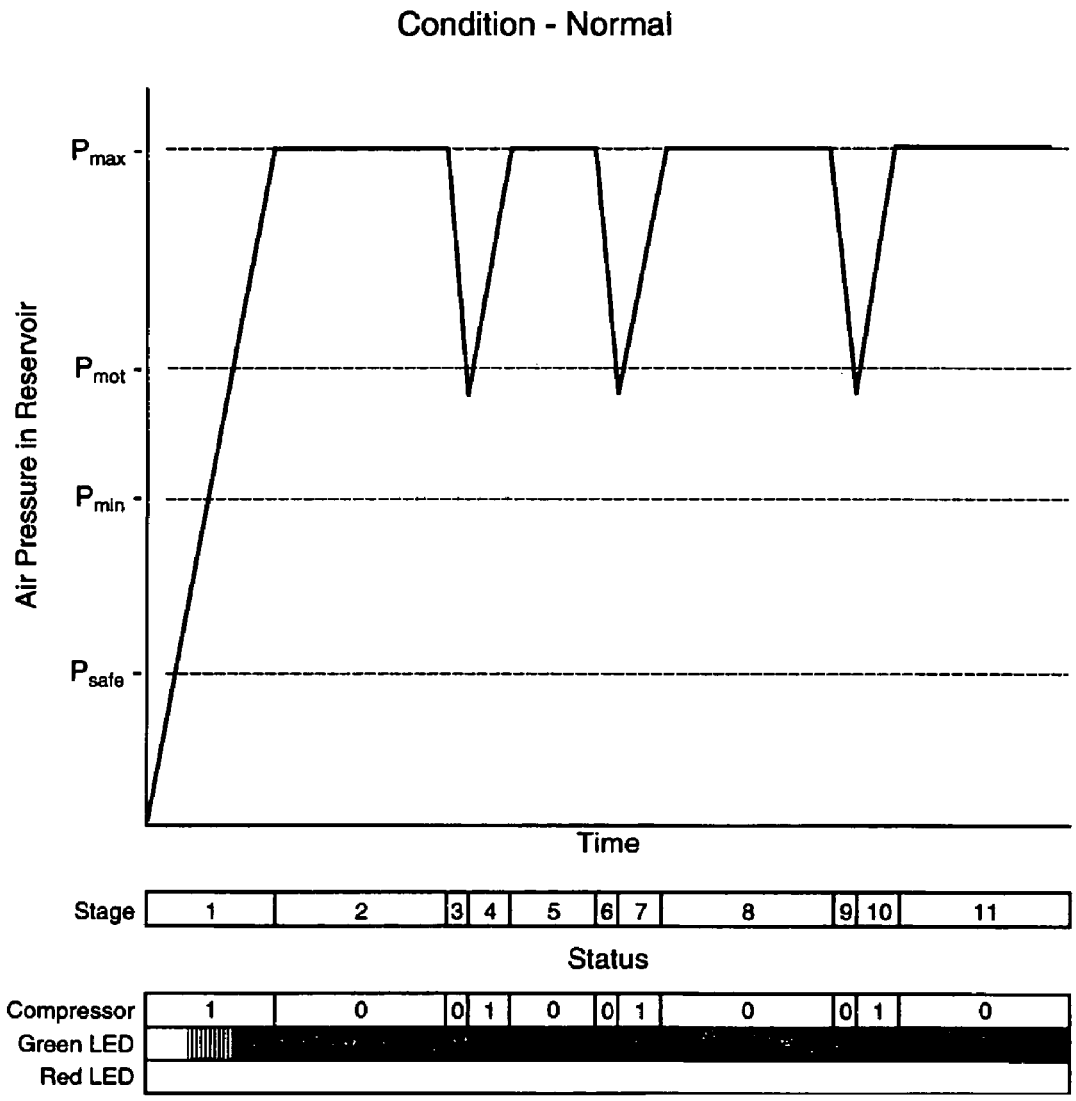
FIGS. 12-16 are charts demonstrating, in several different operating conditions, the operation of a control system which can be used with the invention.

FIG. 12 illustrates the operation of control circuitry 240 in a normal operating condition by showing the fluctuation of the pressure in the compressed air reservoir 210. The brad nailer is turned on in stage 1 by actuation of the switch 243. When the pressure in the compressed air reservoir 210 measured by the pressure transducer 241 ("the measured pressure") is below the value of $P_{mot}$, the control circuitry 240 responds by turning on the electric motor 120. The value of "1" in the "Compressor" register indicates that the compressor assembly is running. With the compressor assembly running, the measured pressure climbs until it reaches the value of $P_{max}$. When the measured pressure is above $P_{max}$, the control circuitry 240 responds by shutting off the electric motor 120. The value of "0" in the "Compressor" register indicates that the compressor assembly is off in stage 2.

In stage 3, the user pulls the trigger 30 to fire a brad. The measured pressure decreases as a result of the volume of compressed air lost to drive the brad. Because the measured pressure falls below $P_{mot}$ in stage 4 the control circuitry 240 turns on the electric motor 120. When the measured pressure returns to the level of $P_{max}$, the control circuitry 240 turns off the electric motor 120 in stage 5. In stage 6, the user pulls the trigger 30 to fire a second brad. As before, the control circuitry 240 detects that the measured pressure has fallen below $P_{mot}$ and turns on the electric motor 120 in stage 7. This illustrates the logic of the control circuitry 240 in a normal operating condition.

With the proper sizing of the compressed air reservoir 210 and appropriate adjustments made to the control circuitry 240, it would be possible to fire a brad twice before the control circuitry turns on the electric motor 120 to recharge the compressed air reservoir 210. This would be advantageous because it would permit the firing of several brads in rapid succession.

The functioning of the green LED indicated in FIG. 12 will now be explained. The green LED is part of the set of LEDs 242 (FIG. 2) which may protrude from the compressor cover 110. The green LED is turned off by the control circuitry 240 when the measured pressure is below $P_{safe}$. $P_{safe}$ is predetermined to be the pressure at which accidental actuation of the trigger 30 would most likely not cause any injury by firing or partially firing a brad since the pressure is low. Thus, it is thought that no signal need be given to a user when the pressure is below the level of $P_{safe}$. The green LED is turned on to flash by the control circuitry 240 when the measured pressure is above the level of $P_{safe}$ and below the level of $P_{min}$. This is shown by the presence of intermittent shaded bars in the "Green LED" register of FIG. 12. The flashing green LED signals to the user that the tool, if accidentally actuated, may be capable of causing an injury. The flashing green LED also indicates that the pressure in the compressed air reservoir 210 is not sufficient to completely drive the brad if the trigger 30 were pulled at that time. Thus, $P_{min}$ is predetermined to be the minimum pressure level at which the nailer is capable of completely driving the brad into the workpiece. When the green LED is flashing, the user is made aware that the nailer can be fired, but that the brad will be left proud of the surface of the workpiece. Once the measured pressure is above $P_{min}$, the green LED is turned on, indicating that the brad nailer is ready to fire a brad at any time. This is indicated by the presence of solid shading in the "Green LED" register.

The values of $P_{max}$ and $P_{mot}$ may be selected by the user during use of the nailer. The switch 243 may be provided with several positions each corresponding to a different set of values for $P_{max}$ and $P_{mot}$. In FIG. 2, a switch 243 is illustrated which has a "Normal" and a "High" position. The brad nailer is on when the switch 243 is in the "Normal" or the "High" position. The "High" position sets the values of $P_{max}$ and $P_{mot}$ higher than the "Normal" position. The value of $P_{min}$ might also be controlled by the position of switch 243. Also, switch 243 may have more than two on positions for an even greater degree of adjustability.

The ability to select the values for $P_{max}$ and $P_{mot}$ allows the user to tailor the operation of the nailer to the work to be done. As the type and size of brad and the workpiece hardness varies, the minimum amount of driving force needed to completely drive the brad will also vary. Adjustment of the values for $P_{max}$ and $P_{mot}$ allows the pressure of the compressed air to be held closer to the minimum pressure corresponding to the minimum amount of driving force needed.

The tailoring of the values of $P_{max}$ and $P_{mot}$ has several benefits. Electrical power will be conserved because the pressure of the compressed air used to drive the drive piston will not be dramatically greater than what is needed to drive the brad. Also, the efficiency of the compressor 130 increases as the pressure of the compressed air decreases. Conservation of electrical power is particularly important if the electrical power source is a battery. Also, the running time of the compressor assembly 100 will be minimized. Use of the tool could be uncomfortable if the compressor assembly 100 runs too much.

Figure 17:
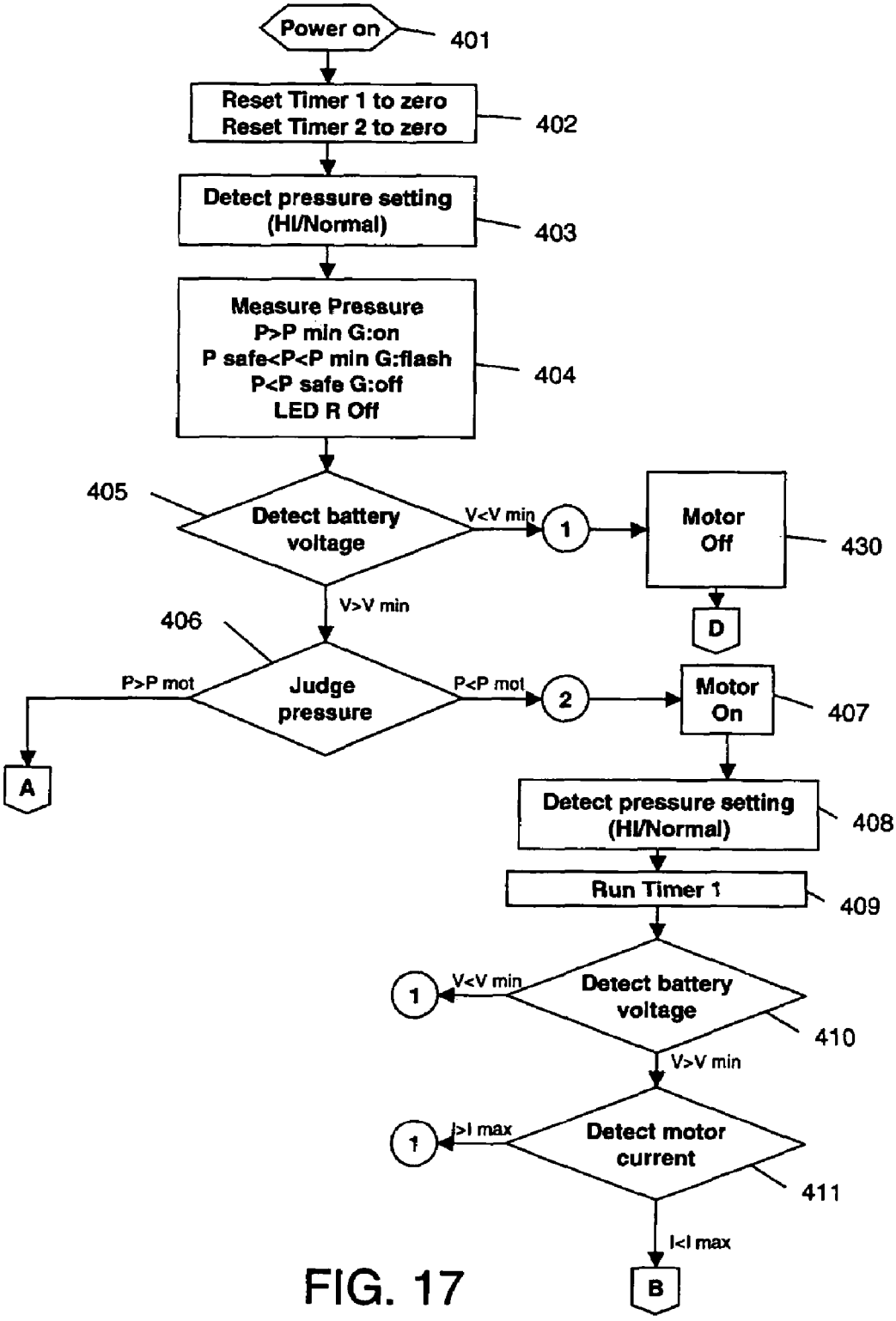
FIGS. 17-19 are flow charts illustrating the logical steps of the control system demonstrated in FIGS. 12-16.
Figure 18:
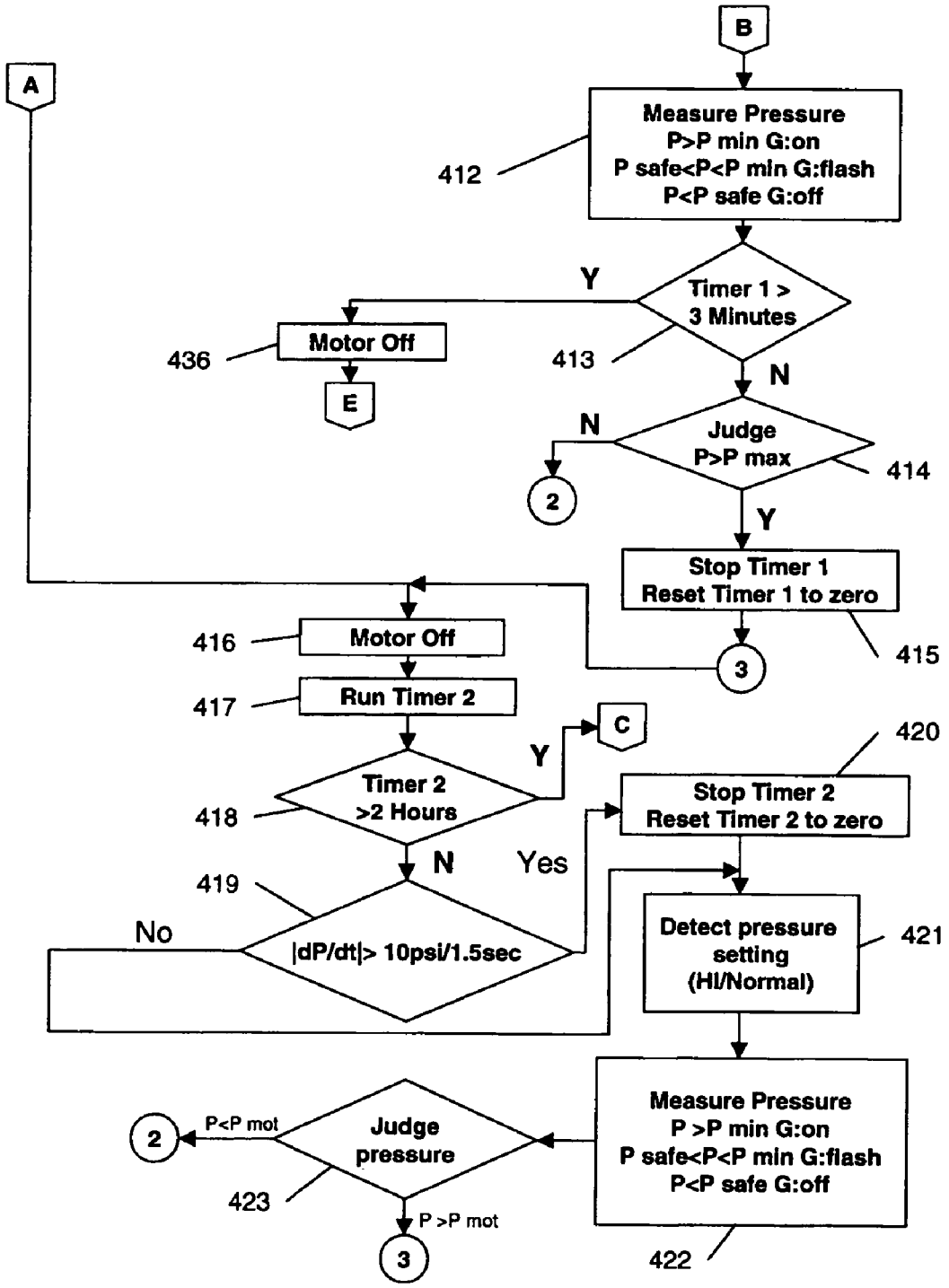
Figure 19:
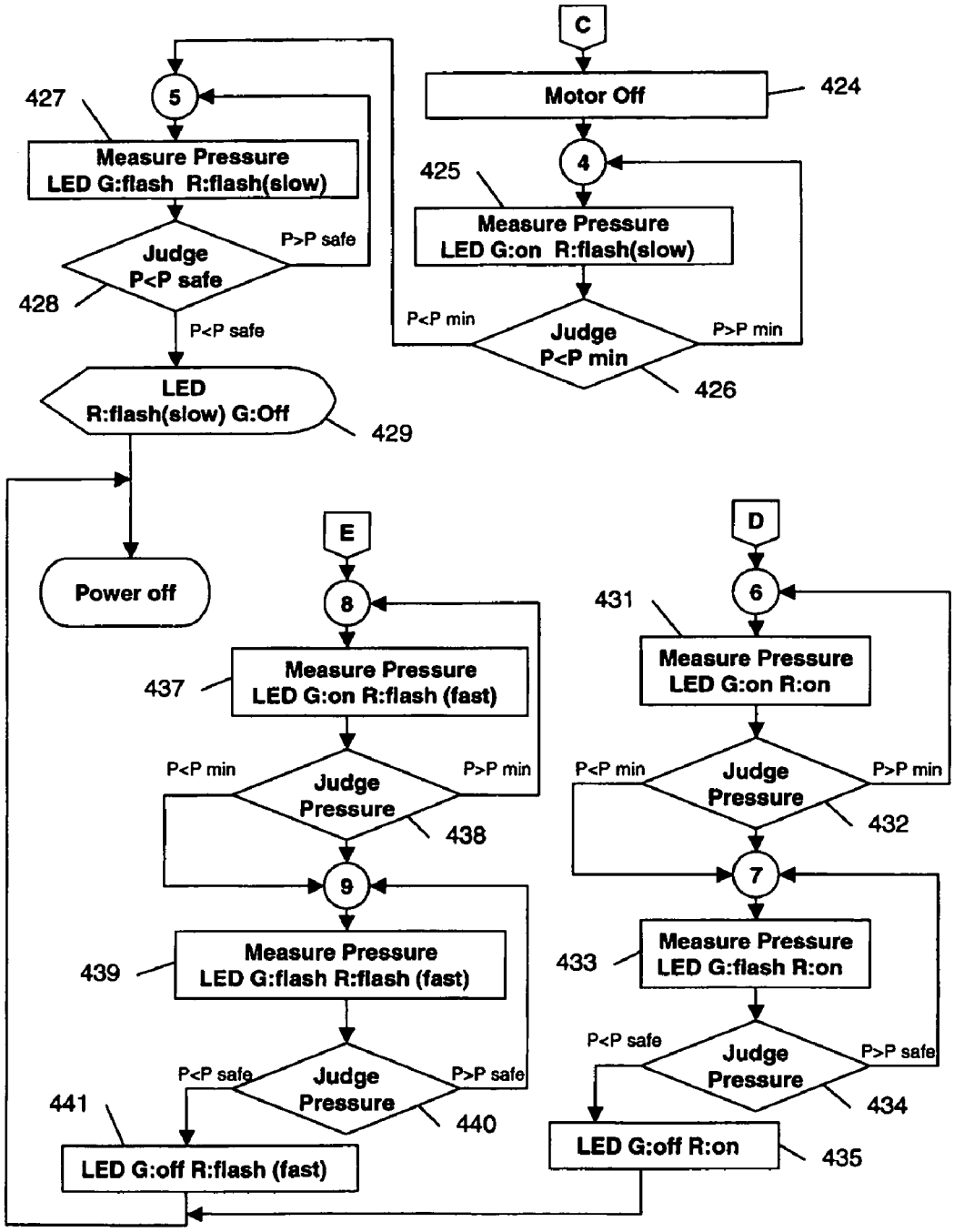

With reference to FIGS. 17-19, an example of the logic followed by the control circuitry 240 during the normal operating condition is shown. FIGS. 17-19 are flow charts which represent the logical steps followed by the control circuitry 240 in operating the brad nailer. Only the logical steps relevant to the normal operating condition of the nailer will be described now. The other steps will be described later when explaining the other operating conditions of the nailer.

In step 401 in FIG. 17, the switch 243 is moved to an on position. The position of the switch 243, i.e. whether it is in the "High" or "Normal" position, is detected in step 403. This detection sets the values for $P_{max}$ and $P_{mot}$. The pressure in the compressed air reservoir 210 is measured by the pressure transducer 241 in step 404. The LEDs 242 are also turned on or off in step 404 according to the measured pressure. In step 406, the measured pressure is judged against the value of $P_{mot}$.

If the measured pressure is less than $P_{mot}$ then the electric motor 120 is turned on in step 407. The position of switch 243 is detected again in step 408 and the values for $P_{max}$ and $P_{mot}$ are established. Moving to point B in FIG. 18, the pressure is measured again using the pressure transducer 241 and the LEDs are turned on and off according to the measured pressure in step 412. In step 414, the measured pressure is judged against the value of $P_{max}$. If the measured pressure is less than the value of $P_{max}$, the logic returns to step 2 in FIG. 17 and the electric motor 120 remains on to continue charging the compressed air reservoir 210. The logic will normally loop between steps 407 and 414 until the measured pressure is greater than $P_{max}$.

If in step 414 the measured pressure is greater than $P_{max}$, then the electric motor 120 is turned off in step 416. The position of switch 243 is detected again in step 421 and the pressure is measured and the LEDs are turned on and off in step 422. The measured pressure is judged against $P_{mot}$ in step 423. If the measured pressure is greater than $P_{mot}$ then the logic returns to step 3 and then to step 416 in FIG. 18. The logic will normally loop between steps 416 and 423 until the measured pressure is less than $P_{mot}$. If the measured pressure is less than $P_{mot}$ in step 423, then the logic returns to step 2 in FIG. 17 where the electric motor is turned on in step 407 and the compressed air reservoir 210 is recharged. As before, the logic will normally loop between steps 407 and 414 until the measured pressure is greater than $P_{max}$.

Figure 13:
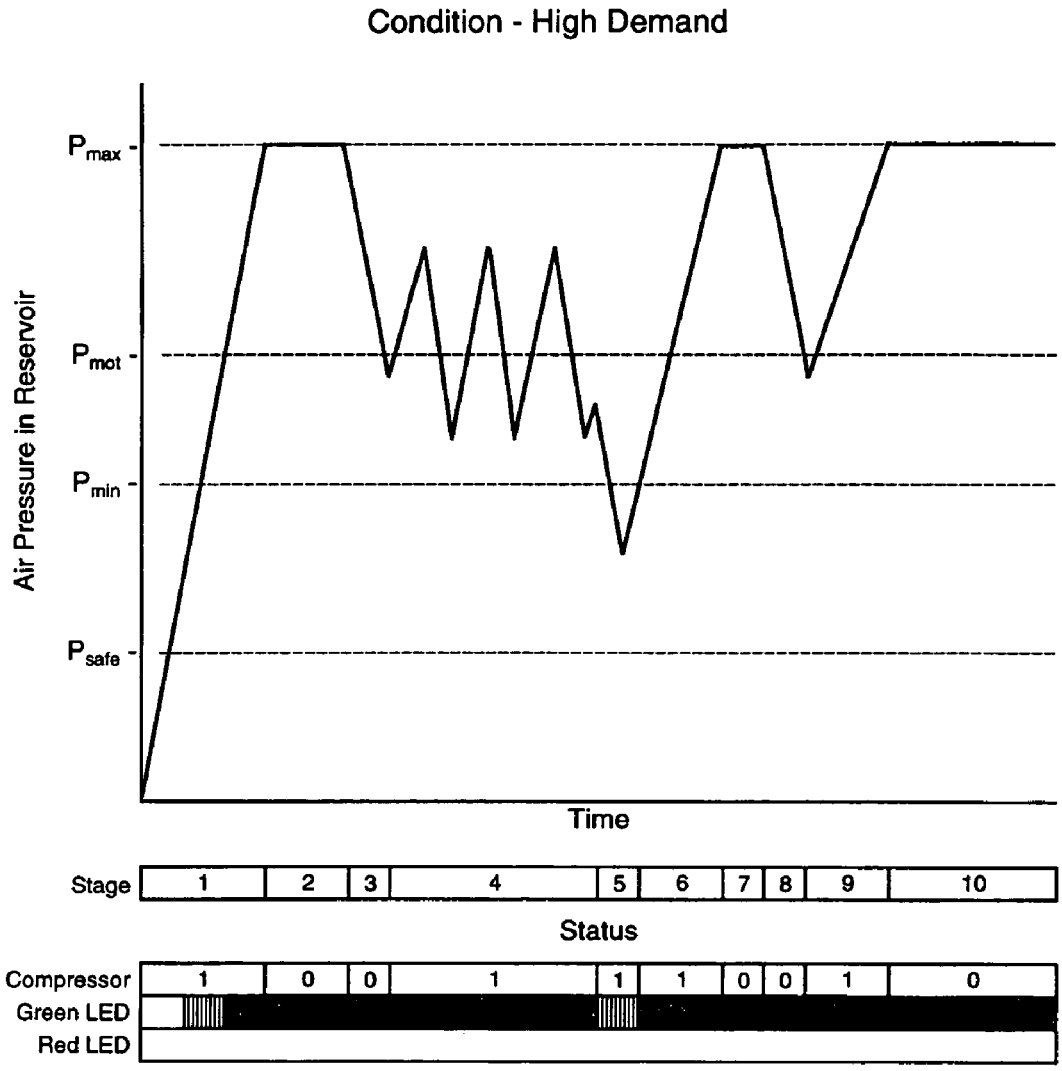

FIG. 13 illustrates the operation of control circuitry 240 in a high demand condition. This operation is the same as the normal operation illustrated in FIG. 12 with the exception of the green LED. In the high demand condition, the brad nailer is fired several times in rapid succession in stages 3 and 4. This causes the measured pressure to dip below $P_{min}$ in stage 5. When this occurs, the control circuitry 240 turns the green LED on to flash, signaling to the user that the brad nailer is not ready to fire until the air pressure can recover. The green LED can be turned on to flash in steps 404,412 and 422 in the logic illustrated in FIGS. 17 and 18.

Figure 14:
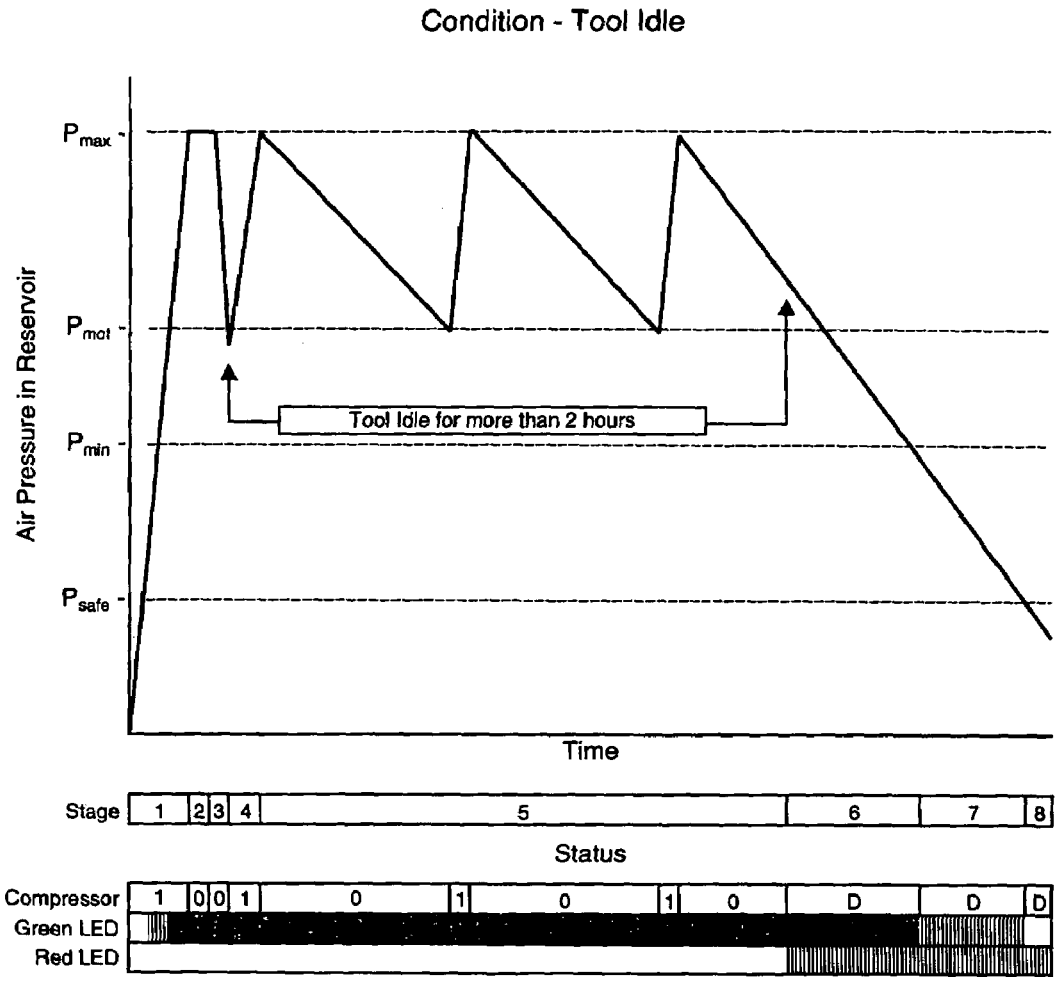

FIG. 14 illustrates the operation of the control circuitry 240 in a tool idle condition. A single brad is fired in stage 3 and the measured pressure drops below the value of $P_{mot}$. In stage 4, the measured pressure is judged against the value of $P_{mot}$ in step 423 of FIG. 18. Because the measured pressure is below the value of $P_{mot}$, the control circuitry turns on the electric motor 120 according to step 407 in FIG. 17. The air pressure recovers in stage 4 as the compressed air reservoir 210 is recharged. When the measured pressure is judged greater than $P_{max}$ in step 414 of FIG. 18, the electric motor 120 is turned off in step 416. In step 417, a Timer 2 is set to run. The control logic then loops between steps 416 and 423. In stage 5, the measured pressure decreases very slowly over time (the time domain axis in FIG. 14 has been distorted for illustrative purposes) due solely to leakage of compressed air from the compressed air reservoir 210. At least some leakage of compressed air from the compressed air reservoir 210 is inevitable. When the measured pressure is judged less than the value of $P_{mot}$ in step 423, the control circuitry 240 again turns on the electric motor 120 at step 407 in FIG. 17.

It is not desirable that this cycle of slowly discharging the compressed air reservoir 210 due to leakage and then recharging be allowed to continue indefinitely. If this cycle in stage 5 were allowed to continue indefinitely, then the charge of the battery 300 would be eventually exhausted. This tool idle situation is most likely to occur when the user puts away the brad nailer without turning off the switch 243.

To prevent this undesirable cycle of slow discharging and recharging, the value of Timer 2 is judged in step 418 of FIG. 18. If the value of Timer 2 is greater than about 2 hours (or any desirable value), then the control logic passes to position C in FIG. 19. If the value of Timer 2 is not greater than about two hours, then the time rate of change of the measured pressure is judged in step 419. If the time rate of change of the measured pressure is greater than about 10 psi/sec (or any other appropriate standard), then the Timer 2 is reset to zero in step 420 and continues to run, and the pressure is then measured in step 421. Otherwise, the logic passes directly to step 421 and the Timer 2 continues to run. Thus, if the time rate of change of the measured pressure never rises above about 10 psi/sec which indicates that the brad nailer has not been fired during that time period, then Timer 2 will eventually reach about two hours and the logic will pass to point C after step 418.

Point C in FIG. 19 is the beginning of an auto shut-off procedure. The electric motor 120 is turned off in step 424. The disabled compressor is indicated by a "D" in the "Compressor" register in stage 6 of FIG. 14. The pressure is measured in step 425 and the green LED is turned on and the red LED is turned on to flash slowly. In stage 6 of FIG. 14, the slowly flashing status of the red LED is indicated by intermittent shaded regions in the "Red LED" register. The measured pressure is judged in step 426. If the measured pressure is judged greater than $P_{min}$, then the logic returns to step 4 and then to step 425. The logic will loop between steps 425 and 426 until the measured pressure falls below the value of $P_{min}$.

When the measured pressure is judged less than $P_{min}$ in step 426 due to the continuing leakage from the compressed air reservoir 210, in step 427 the air pressure is measured again and the green LED is turned on to flash and the red LED is turned on to flash slowly. The flashing green and red LEDs are shown in stage 7 of FIG. 14. In step 428, the measured pressure is judged against $P_{safe}$. If the measured pressure is judged greater than $P_{safe}$, then the logic returns to step 5 and then to step 427. The logic will loop between steps 427 and 428 until the measured pressure falls below the value of $P_{safe}$.

When the measured pressure is judged less than $P_{safe}$ in step 428, the green LED is turned off and the red LED is turned on to flash slowly in step 429. The flashing red LED is shown in stage 8 of FIG. 14. The logic of control circuitry 240 will remain at step 429 in an auto shut-off state until the switch 423 is turned to the off position. The continuing slow flashing of the red LED will alert the user that the nailer is in an auto shut-off condition.

Figure 15:
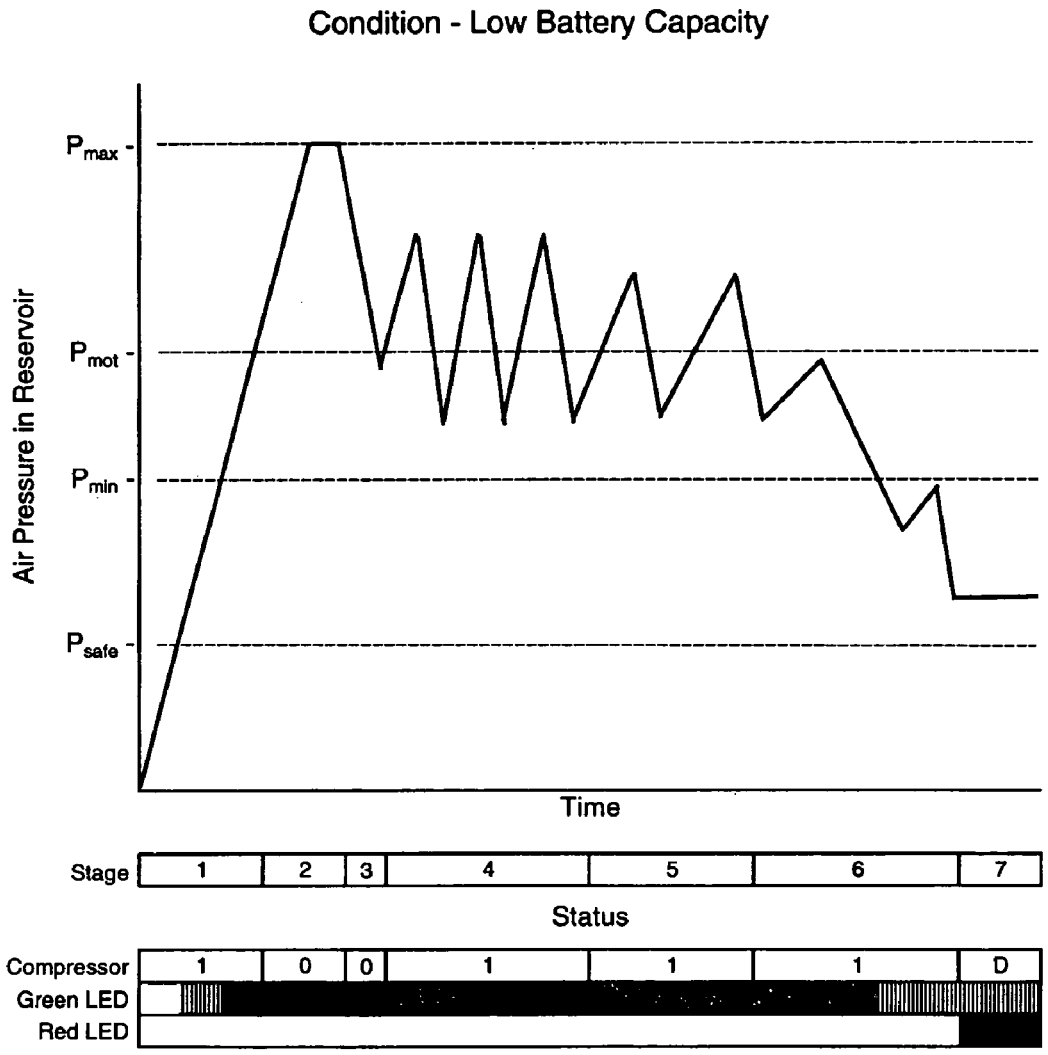

FIG. 15 illustrates the operation of the control circuitry 240 in a low battery capacity condition. Obviously, this low battery capacity condition is only applicable when a battery 300 is used as the electrical power source. If a power cord and an external power outlet are used as the only electrical power source, then the features described below will not be necessary. In stage 3 in FIG. 15, a first brad is fired and as a result the air pressure drops in the compressed air reservoir 210. In stage 4, the control circuitry 240 turns on the electric motor 120 to recharge the compressed air reservoir as the user continues to fire brads. In stage 5, the slope of the pressure curve between firing the brads indicates that the pressure is recovering more slowly because the capacity of battery 300 has been substantially exhausted. In stage 5, while the compressor assembly 100 is recharging the compressed air reservoir 210, the logic of control circuitry 240 is looping between steps 407 and 414 in FIGS. 17 and 18. In stage 6 several more brads are fired and the air pressure drops below the level of $P_{min}$. The control circuitry 240 responds by turning the green LED on to flash in step 412 in FIG. 18.

Another brad is fired in stage 6 and finally the electric motor 120 stalls. The control circuitry 240 detects the stall in step 410 or 411 by detecting the voltage and current from the battery. If the battery voltage is less than a predetermined limit or if the battery current is greater than a predetermined limit, then the logic proceeds to step 1 and step 430 in FIG. 17 where the electric motor 120 is turned off. If the control circuitry 240 did not turn off the electric motor 120 there is a substantial risk that the electric motor 120 could be burned out during the stall. A depleted battery can also be detected in step 405 after the brad nailer is turned on by checking the battery voltage. After the electric motor 120 is turned off in step 430, the logic passes to point D in FIG. 19.

Point D in FIG. 19 is the beginning of an auto shut-off procedure which is entered when the battery 300 is exhausted. The disabled state of the compressor is shown by a "D" in the "Compressor" register in stage 7 of FIG. 15. In step 431 the air pressure in the compressed air reservoir 210 is measured by the pressure transducer 241 and the green and red LEDs are turned on. In step 432 the measured pressure is judged against the value of $P_{min}$. If the measured pressure is greater than the value of $P_{min}$, then the logic passes to step 6 and then to step 431. The logic loops between steps 431 and 432 until the measured pressure falls below $P_{min}$.

If in step 432 the measured pressure is less than the value of $P_{min}$, then in step 433 the pressure is again measured and the green LED is turned on to flash and the red LED is turned on. In step 434 the measured pressure is judged against the value of $P_{safe}$. If the measured pressure is greater than the value of $P_{safe}$, then the logic passes to step 7 and then to step 433 again. The logic loops between steps 433 and 434 until the measured pressure falls below the value of $P_{safe}$.

If the measured pressure is less than the value of $P_{safe}$ in step 434, then in step 435 the green LED is turned off and the red LED is turned on. The logic remains at step 435 until the brad nailer is turned off. The red LED signals to the user that the nailer is in an auto shut-off procedure because the battery is exhausted.

Figure 16:
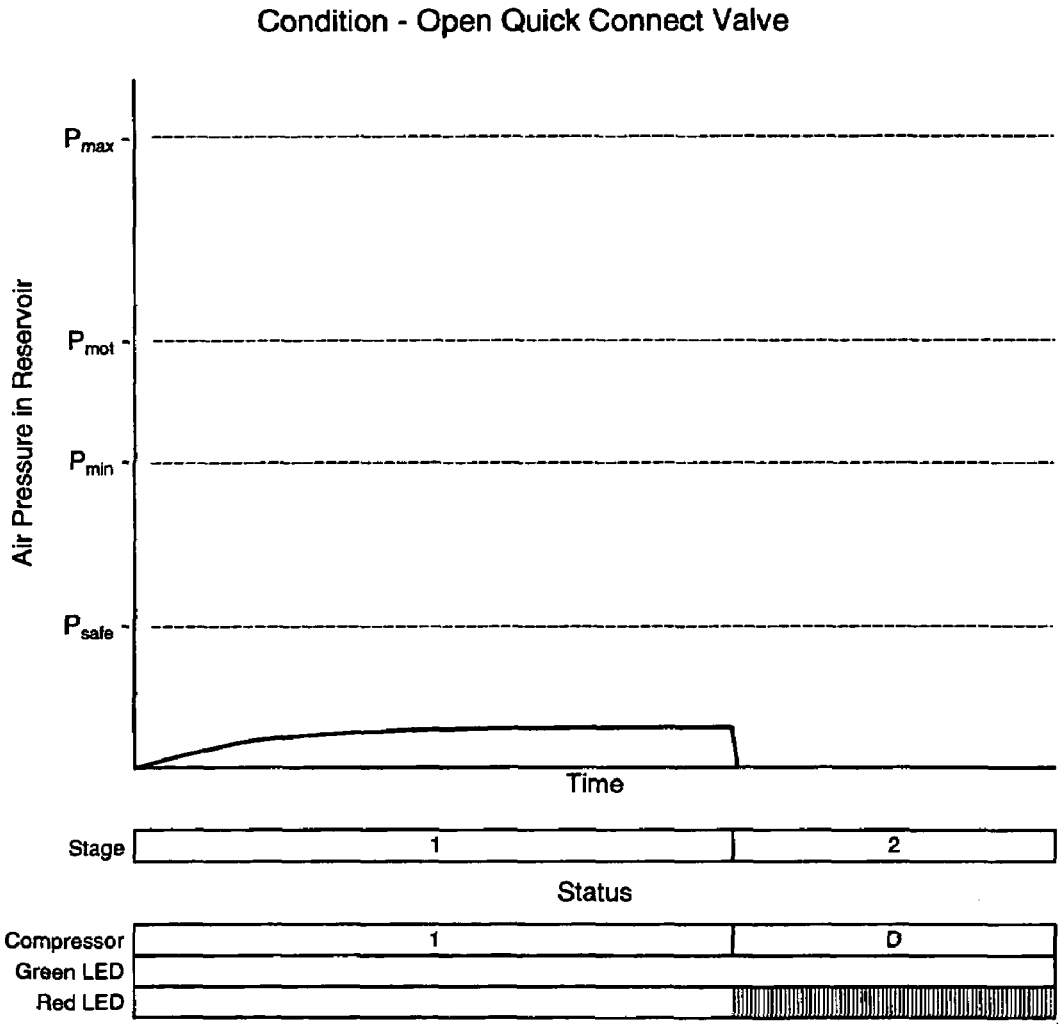

FIG. 16 illustrates the operation of the control circuitry 240 in an open quick-connect valve condition. This condition will occur when the valve 252 of port 250 has been accidentally left open by the user and now the user is trying to use the onboard compressor assembly 100 for compressed air. In stage 1, the switch 243 is turned on and because the measured pressure is below $P_{mot}$, the control circuitry 240 turns on the electric motor 120 in step 407 of FIG. 17 to recharge the compressed air reservoir 210. The measured pressure does not substantially build, however, because the compressed air is escaping through the open valve 252. After the electric motor 120 is turned on in step 407 and the position of the switch 243 is detected in step 408, a Timer 1 is set to run in step 409 (both Timer 1 and Timer 2 were reset to zero in step 402 when the switch 243 is first turned on). The control logic loops between steps 407 and 414 as the compressor assembly 100 is attempting to recharge the compressed air storage 210. Eventually, in step 413 the Timer 1 will be judged to be greater than about three minutes (or any other appropriate limit), at which point the electric motor 120 will be turned off in step 436. However, if instead the measured pressure reaches the value of $P_{max}$ before Timer 1 surpasses about three minutes, then Timer 1 is reset to zero in step 415. After step 436, the logic passes to point E in FIG. 19.

Point E begins an auto shut-off procedure which the control circuitry 240 enters when the valve 252 is left open and the onboard compressor assembly 100 tries to recharge the compressed air reservoir 210. The disabled state of the compressor is shown by a "D" in the "Compressor" register in stage 2 of FIG. 16. In step 437 the air pressure in the compressed air reservoir 210 is measured by the pressure transducer 241 and the green LED is turned on and the red LED is turned on to flash. The flashing red LED is indicated by intermittent shaded bars in the "Red LED" register in FIG. 16. In step 438 the measured pressure is judged against the value of $P_{min}$. If the measured pressure is greater than the value of $P_{min}$, then the logic passes to step 8 and then again to step 437. The logic loops between steps 437 and 438 until the measured pressure falls below $P_{min}$.

If in step 438 the measured pressure is less than the value of $P_{min}$, then in step 439 the pressure is again measured and the green LED and red LED are each turned on to flash. In step 440 the measured pressure is judged against the value of $P_{safe}$. If the measured pressure is less greater than the value of $P_{safe}$, then the logic passes to step 9 and then to step 439 again. The logic loops between steps 439 and 440 until the measured pressure falls below the value of $P_{safe}$.

If the measured pressure is less than the value of $P_{safe}$ in step 440, then in step 441 the green LED is turned off and the red LED is turned on to flash. The logic remains at step 441 until the brad nailer is turned off. The continuing flashing of the red LED signals to the user that the nailer is in an auto shut-off procedure because the valve 252 has been left open.

The invention claimed is:

1. A compressor assembly for providing compressed gas to a pneumatic tool, the compressor assembly comprising:

a compressor;

a tank formed in a handle portion of the pneumatic tool and fluidly connected with the compressor, the tank providing a compressed gas reserve to power a drive piston; and an electric motor operatively connected to and powering the compressor;

wherein the electric motor is alternatively powered by one of a battery and an AC power supply.

2. The compressor assembly of claim 1, wherein the electric motor is a DC motor, and further comprising an AC/DC converter that converts input from the AC power source to DC power usable by the DC motor.

3. The compressor assembly of claim 2, wherein the AC power supply provides DC power to the motor at a voltage between approximately 6.0 VDC and approximately 43 VDC.

4. The compressor assembly of claim 2, wherein the DC motor is a permanent magnet DC motor.

5. The compressor assembly of claim 4 further comprises one or more gears coupling the motor with the compressor.

6. The compressor assembly of claim 4 further comprising a drive belt coupling the motor with the compressor.

7. The compressor assembly of claim 4, wherein the permanent magnet DC motor has a minimum running horsepower of approximately 0.5 HP.

8. The compressor assembly of claim 1 further adapted to receive and electrically connect with the battery.

9. The compressor assembly of claim 8 further comprising a switching mechanism that electrically disconnects the AC power supply from the motor when the battery is connected with the compressor assembly.

10. The compressor assembly of claim 8, wherein the compressor assembly is adapted to receive a plurality of batteries of different voltages.

11. The compressor assembly of claim 9, wherein the switching mechanism comprises a mechanical interlock.

12. The compressor assembly of claim 10, wherein each of the plurality of batteries provides DC power to the motor at a voltage between approximately 6.0 VDC and approximately 43.0 VDC.

13. The compressor assembly of claim 1 further comprising a relay for electrically disconnecting the battery from the motor when the AC power supply is connected with the AC power source.

14. The compressor assembly of claim 1, wherein the AC power supply provides electric power for charging the battery.

15. The compressor assembly of claim 14, wherein the AC power supply provides electric power for charging the battery while simultaneously providing electric power for driving the electric motor.

16. The compressor assembly of claim 1, wherein the AC power source has a voltage between approximately 90 VAC and approximately 260 VAC and a frequency between approximately 48 Hz and approximately 63 Hz.

17. The compressor assembly of claim 1 wherein the tank provides a compressed gas reserve of sufficient capacity to power pneumatic tools, and the gas reserve is selectively expelled from the tank to power at least one pneumatic tool.

18. The compressor assembly of claim 17, wherein the tank has a volume of at least approximately 0.5 L.

19. The compressor assembly of claim 1 further comprising a control system, the control system comprising:

pressure sensing means for sensing the pressure of the compressed gas in the tank; and control means for controlling the electric motor;

wherein the control system is adapted to turn on the flow of electric power to the electric motor when the pressure falls below a first predetermined value, and turn off the flow of electric power to the electric motor when the pressure rises above a second predetermined value.

20. The compressor assembly of claim 1 wherein the tank is further adapted to power the drive piston to drive a fastener.

* * * * *